US008997509B1

(12) United States Patent
Wiggs

(10) Patent No.: US 8,997,509 B1
(45) Date of Patent: Apr. 7, 2015

(54) FREQUENT SHORT-CYCLE ZERO PEAK HEAT PUMP DEFROSTER

(76) Inventor: B. Ryland Wiggs, Franklin, TN (US)

( * ) Notice: Subject to any disclaimer, the term of this patent is extended or adjusted under 35 U.S.C. 154(b) by 1063 days.

(21) Appl. No.: 13/045,260

(22) Filed: Mar. 10, 2011

Related U.S. Application Data

(60) Provisional application No. 61/316,466, filed on Mar. 23, 2010, provisional application No. 61/312,645, filed on Mar. 10, 2010.

(51) Int. Cl.
*F25D 21/00* (2006.01)
*F25B 30/02* (2006.01)

(52) U.S. Cl.
CPC ..... *F25B 30/02* (2013.01)

(58) Field of Classification Search
CPC ..... F25D 21/008; F25B 47/02
USPC ..... 62/234, 278, 467, 80, 115, 151, 159, 62/196.4, 238.6, 468, 324.1
See application file for complete search history.

(56) References Cited

U.S. PATENT DOCUMENTS

| | | | |
|---|---|---|---|
| 2,063,646 | A | 12/1936 | Whitesel |
| 2,503,456 | A | 4/1950 | Smith |
| 3,099,140 | A | 7/1963 | Leimbach |
| 3,183,675 | A | 5/1965 | Schroeder |
| 3,452,813 | A | 7/1969 | Watkins et al. |
| 3,986,345 | A | 10/1976 | Pilz et al. |
| 4,010,731 | A | 3/1977 | Harrison |
| 4,094,356 | A | 6/1978 | Ash et al. |
| 4,169,554 | A | 10/1979 | Camp |
| 4,182,133 | A | 1/1980 | Haas et al. |
| 4,189,848 | A | 2/1980 | Ko et al. |
| 4,224,805 | A | 9/1980 | Rothwell |
| 4,257,239 | A | 3/1981 | Partin et al. |
| 4,286,651 | A | 9/1981 | Steiger et al. |
| 4,290,266 | A | 9/1981 | Twite et al. |
| 4,325,228 | A | 4/1982 | Wolf |
| 4,375,831 | A | 3/1983 | Downing, Jr. |
| 4,378,787 | A | 4/1983 | Fleischmann |
| 4,383,419 | A | 5/1983 | Bottum |
| 4,392,531 | A | 7/1983 | Ippolito |
| 4,448,237 | A | 5/1984 | Riley |
| 4,448,238 | A | 5/1984 | Singleton et al. |
| 4,459,752 | A | 7/1984 | Babcock |
| 4,536,765 | A | 8/1985 | Kaminski |

(Continued)

*Primary Examiner* — Cheryl J Tyler
*Assistant Examiner* — Ana Vazquez
(74) *Attorney, Agent, or Firm* — Miller, Matthias & Hull LLP

(57) ABSTRACT

A heat pump system is configured to have a defrost cycle operable during a heating mode of operation. The system uses: larger than conventionally sized capillary tubes at the liquid refrigerant entry end of an exterior air-source heat exchanger; a special amount of additional refrigerant charge; a supplemental hot gas refrigerant transport line extending from the compressor; a special valve in the new supplemental hot gas refrigerant transport line; and another special valve controlling a restriction to the refrigerant flow in the common consolidated vapor refrigerant transport line exiting the exterior heat exchanger. A controller opens the valve in the new supplemental hot gas refrigerant transport line and to simultaneously engages, for a special period of time, the valve controlling the specially sized restriction to the refrigerant flow in the common consolidated vapor refrigerant transport line exiting the exterior heat exchanger at periodic intervals during potential frost conditions. Additionally, the exterior heat exchanger fan is disabled during a part of the defrost cycle.

6 Claims, 1 Drawing Sheet

(56) References Cited

U.S. PATENT DOCUMENTS

| | | | |
|---|---|---|---|
| 4,538,673 | A | 9/1985 | Partin et al. |
| 4,544,021 | A | 10/1985 | Barrett |
| 4,601,933 | A | 7/1986 | Nakamura |
| 4,700,550 | A | 10/1987 | Rhodes |
| 4,715,429 | A | 12/1987 | Mogensen |
| 4,741,388 | A | 5/1988 | Kuroiwa |
| 4,798,056 | A | 1/1989 | Franklin |
| 4,858,679 | A | 8/1989 | Sakaya et al. |
| 4,858,694 | A | 8/1989 | Johnson et al. |
| 4,867,229 | A | 9/1989 | Mogensen |
| 4,936,110 | A | 6/1990 | Kuckens |
| 4,993,483 | A | 2/1991 | Harris |
| 5,025,634 | A | 6/1991 | Dressler |
| 5,025,641 | A | 6/1991 | Broadhurst |
| 5,029,633 | A | 7/1991 | Mann |
| 5,038,580 | A | 8/1991 | Hart |
| 5,054,297 | A | 10/1991 | Furuhama |
| 5,062,276 | A | 11/1991 | Dudley |
| 5,105,633 | A | 4/1992 | Briggs |
| 5,131,238 | A | 7/1992 | Meckler |
| 5,136,855 | A | 8/1992 | Lenarduzzi |
| 5,199,486 | A | 4/1993 | Balmer et al. |
| 5,207,075 | A | 5/1993 | Gundlach |
| 5,224,357 | A | 7/1993 | Galiyano |
| 5,272,879 | A | 12/1993 | Wiggs |
| 5,275,008 | A | 1/1994 | Song et al. |
| 5,277,032 | A | 1/1994 | See et al. |
| 5,313,804 | A | 5/1994 | Kaye |
| 5,381,672 | A | 1/1995 | Haasis |
| 5,383,337 | A | 1/1995 | Baker |
| 5,388,419 | A | 2/1995 | Kaye |
| 5,419,135 | A | 5/1995 | Wiggs |
| 5,461,876 | A | 10/1995 | Dressler |
| 5,477,703 | A | 12/1995 | Hanchar et al. |
| 5,477,914 | A | 12/1995 | Rawlings |
| 5,533,355 | A | 7/1996 | Rawlings |
| 5,560,220 | A | 10/1996 | Cochran |
| 5,561,985 | A | 10/1996 | Cochran |
| 5,564,282 | A | 10/1996 | Kaye |
| 5,598,887 | A | 2/1997 | Ikeda et al. |
| 5,622,057 | A | 4/1997 | Bussjager et al. |
| 5,623,986 | A | 4/1997 | Wiggs |
| 5,651,265 | A | 7/1997 | Grenier |
| 5,671,608 | A | 9/1997 | Wiggs et al. |
| 5,706,888 | A | 1/1998 | Ambs et al. |
| 5,725,047 | A | 3/1998 | Lopez |
| 5,738,164 | A | 4/1998 | Hildebrand |
| 5,758,514 | A | 6/1998 | Genung |
| 5,771,700 | A | 6/1998 | Cochran |
| 5,799,728 | A | 9/1998 | Blume |
| 5,816,314 | A | 10/1998 | Wiggs et al. |
| 5,875,644 | A | 3/1999 | Ambs et al. |
| 5,934,087 | A | 8/1999 | Watanabe et al. |
| 5,937,665 | A | 8/1999 | Kiessel et al. |
| 5,937,934 | A | 8/1999 | Hildebrand |
| 5,941,238 | A | 8/1999 | Tracy |
| 5,946,928 | A | 9/1999 | Wiggs |
| 6,138,744 | A | 10/2000 | Coffee |
| 6,212,896 | B1 | 4/2001 | Genung |
| 6,227,003 | B1 | 5/2001 | Smolinsky |
| 6,276,438 | B1 | 8/2001 | Amerman et al. |
| 6,354,097 | B1 | 3/2002 | Schuster |
| 6,390,183 | B2 | 5/2002 | Aoyagi et al. |
| 6,450,247 | B1 | 9/2002 | Raff |
| 6,521,459 | B1 | 2/2003 | Schooley et al. |
| 6,615,601 | B1 | 9/2003 | Wiggs |
| 6,644,048 | B2 * | 11/2003 | Goth et al. ..... 62/158 |
| 6,751,974 | B1 | 6/2004 | Wiggs |
| 6,789,608 | B1 | 9/2004 | Wiggs |
| 6,892,522 | B2 | 5/2005 | Brasz et al. |
| 6,931,879 | B1 | 8/2005 | Wiggs |
| 6,932,149 | B2 | 8/2005 | Wiggs |
| 6,971,248 | B1 | 12/2005 | Wiggs |
| 7,080,524 | B2 | 7/2006 | Wiggs |
| 7,146,823 | B1 | 12/2006 | Wiggs |
| 7,191,604 | B1 | 3/2007 | Wiggs |
| 7,234,314 | B1 | 6/2007 | Wiggs |
| 7,401,641 | B1 | 7/2008 | Wiggs |
| 7,578,140 | B1 | 8/2009 | Wiggs |
| 7,591,145 | B1 | 9/2009 | Wiggs |
| 7,832,220 | B1 | 11/2010 | Wiggs |
| 7,841,200 | B1 | 11/2010 | Wiggs |
| 7,886,558 | B2 | 2/2011 | Wiggs |
| 2002/0017516 | A1 | 2/2002 | McKeen et al. |
| 2002/0132947 | A1 | 9/2002 | Smith et al. |
| 2002/0194862 | A1 | 12/2002 | Komatsubara et al. |
| 2004/0000399 | A1 | 1/2004 | Gavula |
| 2004/0129408 | A1 | 7/2004 | Wiggs |
| 2004/0206103 | A1 | 10/2004 | Wiggs |
| 2006/0086121 | A1 | 4/2006 | Wiggs |
| 2006/0096309 | A1 | 5/2006 | Wiggs |
| 2007/0074847 | A1 | 4/2007 | Wiggs |
| 2007/0089447 | A1 | 4/2007 | Wiggs |
| 2007/0151280 | A1 | 7/2007 | Wiggs |
| 2008/0016894 | A1 | 1/2008 | Wiggs |
| 2008/0173425 | A1 | 7/2008 | Wiggs |
| 2009/0065173 | A1 | 3/2009 | Wiggs |
| 2009/0095442 | A1 | 4/2009 | Wiggs |
| 2009/0120120 | A1 | 5/2009 | Wiggs |
| 2009/0120606 | A1 | 5/2009 | Wiggs |
| 2009/0133424 | A1 | 5/2009 | Wiggs |
| 2009/0260378 | A1 | 10/2009 | Wiggs |
| 2009/0272137 | A1 | 11/2009 | Wiggs |

* cited by examiner

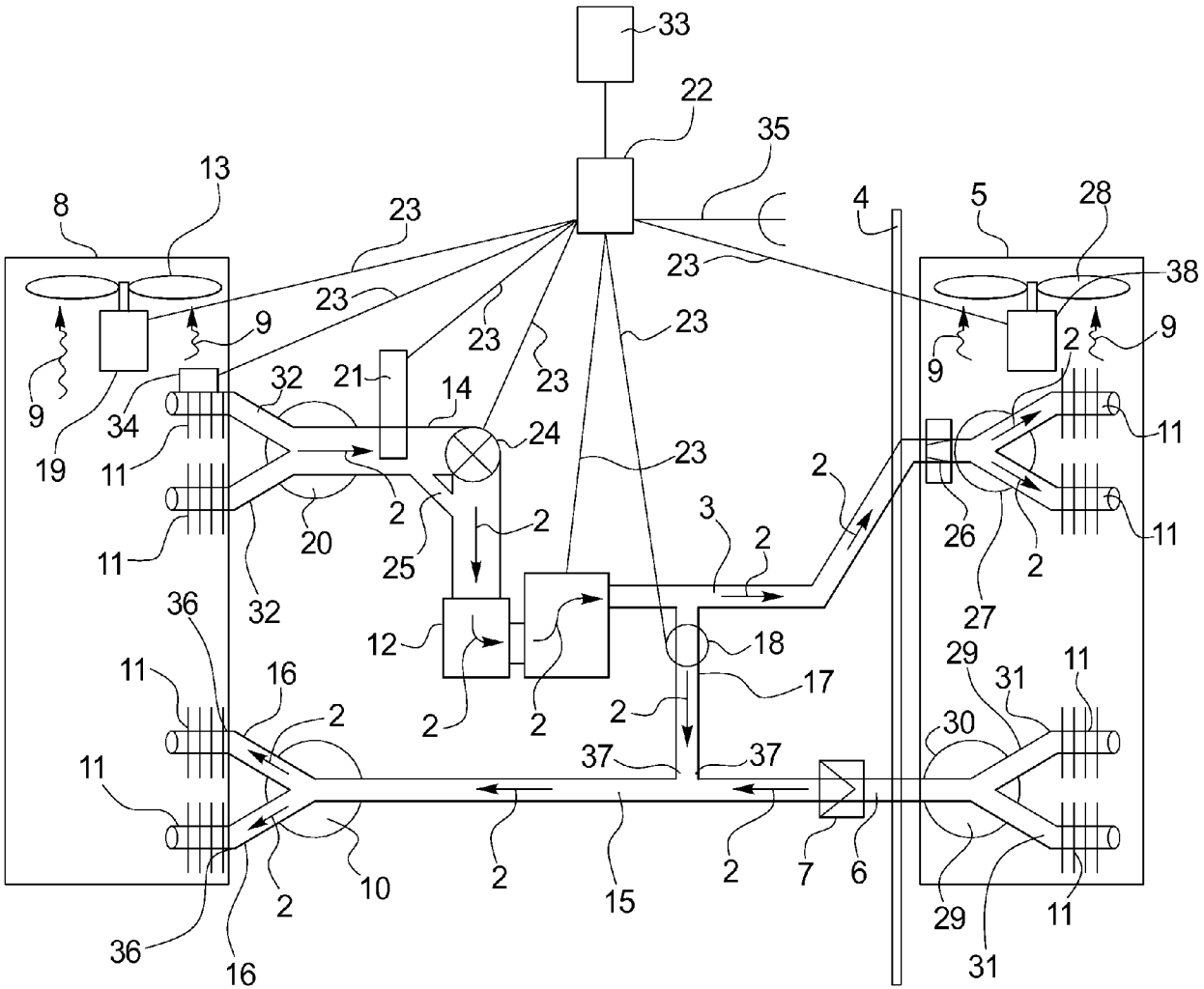
38
9
28
5
11
2
26
27
4
35
33
22
23
3
18
17
37
15
24
14
25
12
21
20
32
34
19
8
13
10
16
36
6
7
29
30
31

FREQUENT SHORT-CYCLE ZERO PEAK HEAT PUMP DEFROSTER

CROSS-REFERENCE TO RELATED APPLICATIONS

The present application claims the benefit of U.S. Provisional Application No. 61/312,645, filed on Mar. 10, 2010, and the benefit of U.S. Provisional Application No. 61/316,466, filed on Mar. 23, 2010, which are incorporated herein by reference.

FIELD OF THE DISCLOSURE

The present disclosure generally relates to a defrost means for a heat pump system that requires minimal consumption of peak electrical power.

BACKGROUND OF THE DISCLOSURE

Heat pump systems are well known. Such systems generally circulate a refrigerant through a closed-loop refrigerant transport system, which system typically includes a compressor, at least two heat exchangers (one interior heat exchanger and one exterior heat exchanger), and at least two expansion devices (one expansion device for each respective heat exchanger).

Heat pump systems are generally either air-source heat pumps, geothermal water-source heat pumps, or geothermal direct exchange ("DX") heat pumps, all of which are well understood by those skilled in the art. Air-source heat pump systems are generally less efficient than geothermal heat pump systems, but the purchase/installation costs of an air-source system is generally less expensive than the purchase/installation costs of a geothermal system. However, the operational and maintenance costs of geothermal heat pump systems (with a DX system typically being the most advantageous) are generally less than those of an air-source heat pump. Thus, purchase/installation costs versus operational and maintenance costs are usually primary considerations in purchasing a specific type of heat pump.

There are several reasons an air-source heat pump is less efficient than a DX geothermal system (a DX system will be used for comparison because it is generally the most efficient heat pump system design). One is that the air-source system requires power to operate an exterior (outdoor) fan, which is not required for a DX system. Another is that an air-source heat pump is dependent on outdoor air temperatures (which can widely fluctuate) as a heat source in the winter and as a heat sink in the summer, while a DX system is dependent on sub-surface temperatures (which remain relatively constant).

Exterior air-source heat exchangers are usually comprised of finned refrigerant transport tubing, with an electric fan to augment air flow across the finned tubing. During the heating mode of operation, the circulating refrigerant is expanded prior to entering the exterior finned tubing in the exterior heat exchanger, so that both the pressure and temperature of the refrigerant fluid will drop. This drop in temperature permits the cold refrigerant to acquire heat from the air, since heat naturally flows to cold. However, when outdoor temperatures are approximately 40-50° F., or lower, naturally occurring moisture in the air is attracted to the cold finned tubing, where the temperature of the expanded and cold refrigerant is usually below the freezing point of water. Consequently, the moisture from the air freezes, creating a layer of frost/ice. As more and more moisture continues to be attracted from the air, more and more frost/ice builds up on the exterior finned refrigerant transport/heat exchange tubing. As the frost/ice builds up, the fan-augmented airflow across the exterior finned heat exchange tubing becomes impaired and adequate operational efficiencies are lost, since not enough heat can be acquired from the exterior air to provide design level heat to the interior space.

Normally, design level heat is supplied to the interior space when the heat absorbed from the exterior air by the refrigerant (circulating within the exterior heat exchange tubing) is accentuated by the compressor, which compressor takes in the cold (but still heat laden) refrigerant vapor and, via compression, increases both the pressure and the temperature of the circulating refrigerant, supplying the now hot refrigerant gas to the interior heat exchanger (which is typically also comprised of finned refrigerant transport tubing and a fan). After most of the heat is transferred to the interior air, the now cooled refrigerant fluid is circulated back to the exterior expansion device, where the process is repeated, to continuously acquire heat from the exterior air and supply the accentuated heat to the interior air.

Specifically regarding heating mode operation in the winter, conventional air-source heat pumps may employ a periodic "defrost" cycle when outdoor temperatures are 40-50° or less. In a typical defrost cycle, a reversing valve is engaged to direct hot refrigerant gas exiting the compressor into the exterior heat exchanger, rather than into the interior heat exchanger, to provide enough heat to melt frost/ice that has built up on the exterior heat exchanger. When the reversing valve is so engaged, the heat pump system actually operates in the cooling mode, just as it normally would in the summer.

Such an instantaneous shift of the reversing valve, to place the air-source heat pump system in a defrost cycle (or actually into the cooling mode), is noisy and is hard on the compressor (contributing to accelerated wear and tear and/or to eventual compressor failure), and simultaneously effectively requires a reverse directional flow of the refrigerant fluid within both the exterior and the interior heat exchangers. Such a reverse refrigerant directional flow also modifies the pre-existing optimum refrigerant fluid charge amount in the respective interior and exterior heat exchangers, requiring additional inefficient operational time to re-establish the optimum respective charges once the defrost cycle is over and the reversing valve is switched back into a normal heating mode position.

Even worse, during a typical defrost cycle, since the air-source heat pump system is actually operating in the cooling mode, heat from the interior air is being removed and transferred into the exterior heat exchanger to help melt the frost/ice build-up. Thus, since the interior air is effectively being air-conditioned, or cooled, during a typical defrost cycle operation in the winter, supplemental (back-up) heat is normally required to be supplied to the interior air to keep it from dropping too far below a comfortable design interior temperature level. Such cooling mode operation in the winter, coupled with a requirement for supplemental heat, is both expensive for the owner of the structure and is expensive for the electric utility company supplying power, as multiple air-source heat pumps in the area tend to create "peaking" concerns for the utility. Such peaking issues require the electric utility to either provide extra generating capacity for only relatively short periods of time, or to pay other electric providers for their extra power availability, both of which are very expensive.

Various methods of removing frost/ice from outdoor refrigerant to air heat exchangers have been developed, inclusive of supplying heat to the exterior heat exchange tubing from an external heat source (which can still be expensive and troublesome), and of supplying heat to the exterior heat exchange tubing from the hot gas discharge line exiting the compressor itself. An example of the later design is found at U.S. Pat. No. 4,279,129 to Cann, et al., as assigned to the Carrier Corporation.

In the '129 patent, hot discharge gas from the compressor discharge line, during the heating mode defrost cycle of operation, is directed simultaneously both into the exterior refrigerant to air heat exchanger and into the accumulator. This is because the stated objective is to provide enough hot gas directly to the exterior heat exchanger to melt the frost/ice, which results in a condensation of the hot gas in the exterior heat exchanger so that at least some, and more than normal, liquid phase refrigerant enters the accumulator. Since there is an increased amount of liquid phase refrigerant in the accumulator, a portion of the compressor's hot gas is also bubbled into the accumulator to vaporize the liquid phase refrigerant in the accumulator.

While the subject defrost disclosure in the '129 patent will work, the design is such that: hot gas refrigerant is not disclosed as being supplied into the exterior heat exchanger, in the heating/defrost mode, through larger than normal liquid phase refrigerant transport lines, which will impair defrost abilities and will disadvantageously increase defrost period timing; there is no restriction shown in the exiting vapor transport line from the exterior heat exchanger, which will impair both defrost ability and will disadvantageously increase defrost period timing; there is no disclosure that any extra refrigerant charge is required, which will impair optimum system operation; an optimum sizing of the hot gas line by-passing the indoor heat exchanger is not disclosed, which makes it impossible to know how to optimize defrost results; and some unidentified amount of the hot gas by-passing the indoor heat exchanger is being directed into the accumulator, thereby not affording full optimum utilization of the by-passing hot gas to provide heat to interior air or to melt the frost/ice on the heat exchange tubing of the exterior heat exchanger, and thereby increasing defrost cycle operational time (which impairs both interior heat supply abilities and defrost cycle operational timing), and which unnecessarily requires hot gas to be directed and bubbled into the accumulator.

Also, since no relatively short and frequent time period for defrost cycle operation is disclosed, via an anticipated normal and customary defrost cycle operation of about four to twelve minutes with Cann et al.'s disclosure (with the defrost cycle operating only when the frost/ice build-up is relatively thick on the exterior heat exchanger's heat transfer tubing), customarily longer periods of defrost cycle operation may be required, resulting in more interior heat losses during the defrost cycle, and resulting in more condensation issues with the hot gas refrigerant used to melt the frost/ice in the outdoor heat exchange tubing (which is an additional likely reason Cann, et al. requires some hot gas to be diverted to the accumulator). Further, by diverting the hot discharge gas into both the exterior heat exchanger and the accumulator during the defrost mode of operation, there will likely be an insufficient amount of hot gas available to supply an optimum amount of heat to the interior air handler during a defrost cycle; and the subject design makes no mention of a timed operation of the fan in the exterior heat exchanger, and, of necessity as disclosed, will impose a power peaking period upon the system as a result of the defrost cycle operation as disclosed therein.

Another example of utilizing hot gas to assist in the defrost cycle of an exterior heat exchanger is found in Park's U.S. Patent Application Pub. No. US 2009/0277207 A1. In the '207 application, hot discharge gas from the compressor discharge line, during the heating mode defrost cycle of operation, is primarily directed in a quantity up to 100% solely into the exterior refrigerant to air heat exchanger. During the defrost cycle, which takes 30-100 seconds, there is no interior heating (see page 5, paragraph 0070). Park also explains that, in a case where there is an excessive quantity of frost, a three-way valve supplies the hot gas to the exterior heat exchanger only at 20-30 second intervals, during which interior heating is interrupted, so that it is difficult for the user to recognize that the heating mode has actually been fully stopped during those 20-30 second intervals (see page 5, paragraphs 0070 and 0071).

Again, while Park's design will work, Park does not provide a full unrestricted 100% hot gas flow into the exterior heat exchanger, through larger than normal liquid phase refrigerant transport lines, since the hot gas primarily goes through a conventional (small) distributor (Park's number 16) and (small) distribution tubes (Park's number 33); Park does not disclose a preferable optimum size of the hot gas by-pass line to the exterior heat exchanger; and Park provides no restriction in the vapor line exiting the exterior heat exchanger, which disadvantageously increases requisite defrost time, requiring more time for the interior air handler to remain totally un-functional, as Park does not simultaneously provide any interior heat (via simultaneously supplying hot gas to the interior air handler) while operating in his primary defrost cycle. Further, testing has indicated that, via switching from defrost to heating every 20-30 seconds, the heat supply ability of the interior air handler is materially impaired, since normal heat supply levels via the interior air handler are lost and take much longer than 20-30 seconds to build back up after the refrigerant flow to the interior air handler has been totally cut off during the preceding 20-30 second period.

Further, in Park's design, there is no disclosure that any extra refrigerant charge is required, which will impair optimum system operation since the addition of extra refrigerant transport lines, as taught by Park, will require some extra charge for optimum system performance; an optimum sizing of the hot gas line by-passing the indoor heat exchanger is not disclosed, which makes it impossible to know how to optimize defrost results; there is no mention of a timed operation of the fan in the exterior heat exchanger, and, of necessity as disclosed, will impose a power peaking period upon the system as a result of the defrost cycle operation as disclosed therein; and the periodic use of a liquid receiver (Park's 43) is required, which is an extra cost and expense that may be unnecessary. Also, it should be noted that Park's design does not call for a frequent cycle defrost mode of operation. Instead, it principally calls for an intense blast of 100% of the compressor's hot discharge gas, during the defrost cycle, traveling through the exterior heat exchanger (with no restriction in the exterior heat exchanger's exiting vapor line) during periods lasting from about 30-100 seconds, which periods are repeated multiple times at 20-30 second intervals when the frost is thick.

SUMMARY OF THE DISCLOSURE

In view of the foregoing, it may be advantageous to provide a defrost means that would effectively mitigate or eliminate any significant (other than minimal) frost/ice build-up on exterior heat exchangers during periods of cold outdoor temperatures; eliminate undue compressor stress; eliminate heat exchanger charge imbalances; eliminate excessive condensation of hot compressor discharge gas within the exterior heat exchanger; eliminate periodic grossly inefficient system operation in the heating season; eliminate at least one of zero heat and less than about 50% of normal heat being supplied through the interior air handler during defrost cycle operation; eliminate any need for a liquid receiver; and at least one of significantly mitigate and eliminate peaking concerns for electric utility companies for heat pump systems operating in the defrost cycle.

Accordingly, a defrost system is provided that will mitigate or eliminate frost/ice build-up on an exterior heat exchanger during periods of cold outdoor temperatures, as well as eliminate undue compressor stress, eliminate heat exchanger charge imbalances, eliminate periodic grossly inefficient system operation in the heating season, provide operational efficiency advantages over other defrost system designs, and mitigate peaking concerns for electric utility companies.

This is accomplished by (1) specially designing the entering (in the heating mode of operation) refrigerant transport tubing to an air-source heat pump exterior heat exchanger; (2) providing a new supplemental hot gas refrigerant transport line that is specially sized to be approximately the same size as the compressor hot gas discharge line, that extends from the refrigerant transport line exiting the compressor and/or oil separator to a common refrigerant transport line segment situated between the heating mode expansion device and the distributor to the entrance of the exterior finned tubing, in the direction of refrigerant flow in the heating mode, of the air-source heat pump's exterior heat exchanger; (3) providing a special valve in the new supplemental hot gas refrigerant transport line that functions only when exterior air temperatures are approximately 40-45° F., or lower, or when minimal frost is detected on the exterior heat exchange tubing; (4) by providing a relatively frequent special valve operation, of a relatively short duration, to relatively frequently effect a short duration flow of hot refrigerant gas/vapor through the new supplemental hot gas line, through the specially designed distributed entering (in the heating mode of operation) refrigerant transport tubing, into the refrigerant transport tubing of the exterior air-source heat pump system; (5) providing a specially sized restriction to the refrigerant flow, when the system is operating in the defrost cycle, in the consolidated vapor refrigerant transport line exiting the exterior heat exchanger, in a location that is past the exterior heat exchanger's exiting vapor line distributor, in the direction of the refrigerant flow in the heating mode, but before the entrance to the first of the accumulator and/or compressor; (6) providing a sensor that senses either when the outdoor temperature is 40-45° F., or lower, or when minimal frost is detected on the exterior heat exchange tubing; (7) providing a controller device that both controls and times the operation of the special valve in the new supplemental hot gas refrigerant transport line and simultaneously operates a valve that controls a specially designed restriction in the consolidated vapor refrigerant transport line exiting the exterior heat exchanger, such that when the special valve is open, the restriction in the consolidated vapor refrigerant transport line is engaged, and such that when the special valve is closed, the restriction in the consolidated vapor refrigerant transport line is disengaged; (8) leaving intact all of the small liquid refrigerant transport capillary tubing, the small liquid line distributor, the consolidated relatively small liquid refrigerant transport line, and the heating mode expansion device, all situate at the exiting end of the interior heat exchanger, in the direction of refrigerant flow in the heating mode; (9) turning the fan in the exterior heat exchange unit off and then back on during specific time periods during the entire defrost cycle, all while leaving the fan in the interior heat exchanger fully operative; and (10) adding an additional refrigerant charge amount to the system that is approximately equal to the total amount of liquid phase refrigerant necessary to fill the additional calculated interior content area within both the new and the larger-sized entering liquid refrigerant transport tubing on the entering side of the exterior heat exchanger, which larger-sized tubing is situated between the heating mode expansion device, the special valve in the supplemental hot gas refrigerant transport line, and the ending point (in the direction of refrigerant flow in the heating mode) of the former small capillary tubing that connected with the finned refrigerant transport tubing within the exterior heat exchanger.

(1) Sizing the Entering (in the Direction of Refrigerant Flow in the Heating Mode of Operation) Refrigerant Transport Tubing of an Air-Source Heat Pump's Exterior Heat Exchanger:

Virtually all air-source heat exchangers have a common smaller-sized liquid refrigerant transport tube transporting mostly liquid phase refrigerant to the exterior air-source heat exchanger, which heat exchanger is typically comprised of finned refrigerant transport tubing, or the like. Before entering the exterior heat exchanger, the liquid phase refrigerant is expanded through an expansion device (typically a pin restrictor or a valve, or the like), to reduce the pressure and the temperature of the refrigerant prior to entering the exterior heat exchanger. The pressure/temperature of the circulating refrigerant is lowered to reduce the temperature to a point well below that of the outside air. The now relatively cold refrigerant will naturally absorb heat from the exterior air, since heat naturally flows to cold, as the refrigerant circulates through the exterior heat exchanger.

However, once the pressure and temperature of the circulating refrigerant is reduced by the expansion device, the refrigerant is typically distributed into multiple relatively small capillary refrigerant transport tubes, or the like, which transport the circulating refrigerant into the typically moderately sized finned tubing of the exterior heat exchanger.

After the reduced temperature/pressure refrigerant (which may be only partially liquid) acquires heat from the exterior air while circulating through the exterior heat exchanger, the refrigerant is transformed into mostly vapor. The now mostly vapor refrigerant, upon exiting the exterior heat exchanger, is distributed back into a common and larger sized vapor refrigerant transport line leading to the compressor.

To provide desirably efficient defrosting, modifications are required to the common and conventional entering (in the heating mode of operation) refrigerant transport tubing of an exterior heat exchanger. Such specific modifications are as follows:

The relatively small capillary tubing, situated between the heating mode expansion device and the moderately sized finned refrigerant transport tubing, may be eliminated and replaced with moderately sized refrigerant transport tubing with about the same refrigerant transport tubing size as that of the larger sized finned refrigerant transport tubing within the exterior heat exchanger.

Testing has demonstrated that if conventionally sized, relatively small capillary tubing is used, defrost times will typically be at least about twice as long, resulting in significantly less overall system operational efficiencies. Further, the conventionally sized capillary tubing may act as a secondary heating mode expansion device, which can impair overall system operation and efficiencies.

In addition to replacing the small capillary tubes as disclosed above, a relatively short segment of the consolidated liquid transport line that connects the capillary tube distributor with the heating mode expansion device will also need to be replaced. This relatively short smaller line segment may be replaced with a larger refrigerant transport line segment that is about the same size as the hot gas discharge vapor line.

Still further, the conventionally small-sized liquid refrigerant distributor, at the entrance to the exterior heat exchanger in the heating mode, will also need to be replaced with a larger-sized distributor capable of accommodating the entering larger refrigerant transport line segment and distributing the refrigerant fluid to the modified, larger sized finned tubing within the exterior heat exchanger noted above.

(2) Providing a Supplemental Hot Gas Refrigerant Transport Line, that is Specially Sized to be Approximately the Same Size as the Hot Gas Discharge Line, that Extends from the Refrigerant Transport Line Exiting the Compressor or Oil Separator to a Common Refrigerant Transport Line Segment Located Between the Heating Mode Expansion Device and the Distributor to the Entrance of the Exterior Finned Tubing, in the Direction of Refrigerant Flow in the Heating Mode, of the Air-Source Heat Pump Exterior Heat Exchanger.

A "T" coupling, or the like, may be placed within the discharge hot gas line of the compressor, or alternatively, within the discharge hot gas line of the oil separator when an oil separator is optionally utilized. Oil separators are well understood by those skilled in the art and, when utilized, are typically situated immediately after the hot discharge refrigerant gas exits the compressor.

A supplemental hot refrigerant gas (vapor) transport line is operably attached to the "T" coupling that extends to a segment of the mostly liquid refrigerant transport line located between the heating mode expansion device and the distributor to the entrance of the exterior heat exchanger in the direction of refrigerant flow in the heating mode, where the supplemental hot gas line is operably attached, again by means of a "T" fitting or the like, to the subject partially liquid refrigerant transport line segment.

The supplemental hot refrigerant gas (vapor) transport line may be sized so that it is approximately at least the same size as the primary hot refrigerant gas (vapor) transport line that is exiting the compressor or oil separator (where size of the refrigerant transport lines are determined by their respective interior area). If the supplemental line is too large, there is a loss of some valuable temperature and pressure at this location. If the supplemental line is too small, not enough hot vapor compressor discharge gas will be permitted to enter the exterior heat exchange tubing to efficiently effect the desired defrost results. Testing has indicated that using a supplemental line that is approximately the same size as the primary compressor hot gas discharge line may be advantageous.

Further, testing has demonstrated that while an appropriate part of the hot discharge gas will be pulled into the exterior heat exchanger, some portion of the hot discharge gas will still circulate through the interior heat exchanger to provide approximately more than half the amount of heat normally provided during defrost cycle operation. Providing approximately half, or more, of the heat provided during normal system operation is far better than taking away large quantities of heat via full operation in the air-conditioning (cooling) mode, as is typically done in conventional defrost modes of operation.

In addition to being pulled into the exterior heat exchanger by the suction of the compressor, via the subject system design, the normal refrigerant flow restriction imposed by the conventionally small capillary tubing exiting the interior air handler (in the heating mode), and the relatively small conventional liquid refrigerant transport line exiting the liquid distributor within the interior air handler, in conjunction with the conventional heating mode expansion device, place some degree of back-pressure on the refrigerant within the interior air handler, to force an appropriate design amount of hot gas refrigerant from the compressor through the supplemental hot gas refrigerant transport line, through the entering distributor servicing the exterior heat exchanger, and into the exterior heat exchanger itself, to effectively melt frost/ice on the finned heat exchange refrigerant transport tubing, or the like, within the exterior heat exchanger.

According to the present disclosure, the conventionally small capillary tubing exiting the interior air handler (in the heating mode), the liquid phase refrigerant distributor (combining the small capillary tubes into a relatively small consolidated liquid refrigerant transport line), and the relatively small consolidated conventional liquid refrigerant transport line exiting the liquid distributor within the interior air handler may all be left at their conventional sizes.

(3) The Special Valve in the Supplemental Hot Gas Refrigerant Transport Line:

A special valve may be situated in the new supplemental hot gas refrigerant transport line. The special valve may be located as close as possible to the primary hot gas refrigerant vapor discharge line exiting the compressor or oil separator. This valve positioning may prevent an unnecessary loss of heat through an unused portion of the supplemental hot gas refrigerant transport line when the defrost cycle is not being utilized.

Further, the special valve may be operated between fully open and fully closed positions, such as a solenoid valve, or the like. Testing has demonstrated that a valve that restricts the full refrigerant flow through the supplemental hot gas refrigerant transport line impairs defrost operation efficiencies.

Additionally, the valve may remain shut at all times when the outdoor air temperatures are about 40-45° F. or greater, and/or when less than a threshold amount of frost is detected on the exterior heat exchange tubing, as there may be no need for a defrost cycle operation. However, when exterior air temperatures are approximately 40-45° F. or lower, and/or when the threshold amount of frost is detected, the valve may be periodically opened as further disclosed herein.

A threshold amount of frost on the exterior heat exchanger is herein defined, as an example only, as frost buildup of approximately 1/32 of an inch. Alternatively, the threshold amount of frost may be defined as enough frost to be visible (typically a white color) on approximately one-third (33.3%) of the finned tubing.

(4) Relatively Frequent Special Valve Operation, of a Relatively Short Duration, to Relatively Frequently Effect a Relatively Short Duration Flow of Hot Refrigerant Gas/Vapor Through the Supplemental Hot Gas Line, Through the Specially Designed Distributed Entering (in the Heating Mode of Operation) Refrigerant Transport Tubing, into the Refrigerant Transport Tubing of the Exterior Air-Source Heat Pump System:

Most conventional defrost systems operate only after permitting frost/ice to build up, typically in excess of about 1/32 of an inch, on the exterior heat exchanger over about a 30 to 90 minute period before the conventional defrost cycle is engaged. This is because it is very hard on the compressor, and it is very expensive to offset the typically defrost cycle's air-conditioning (cooling) the interior air in the winter, with supplemental, or back-up, heat, all while creating refrigerant charge imbalances between the interior and exterior heat exchangers, which charge imbalances may be rectified when switching once again back to the primary heating mode.

As defined herein, a "primary" defrost cycle is where a solenoid valve, or the like, is opened in the new connecting segment of refrigerant transport tubing, and where an approximate 94-95% restriction is engaged in the consolidated vapor refrigerant transport line exiting the exterior heat exchanger. As defined herein, an "entire" defrost cycle is where a solenoid valve, or the like, is opened in the new connecting segment of refrigerant transport tubing, where an approximate 94-95% restriction is engaged in the consolidated vapor refrigerant transport line exiting the exterior heat exchanger, and where the exterior fan is disengaged for a certain period of time.

Rather than letting frost/ice build up to a considerable thickness (with heating operational efficiencies simultaneously suffering), and/or with frost/ice sometimes remaining on the exterior unit outer protective screening, even after melting off the exterior heat exchange tubing itself (and continuing to somewhat impair design air flow), before engaging the defrost cycle, testing has disclosed that, in conjunction with the unique defrost disclosures as taught herein, it may be advantageous to operate the primary defrost system for about 20 seconds, plus or minus about 5 seconds, one time about every 7 minutes, during periods when outdoor air temperatures are about 40-45° F., or lower, and/or when minimal frosting/ice is detected on the exterior heat exchange tubing.

Such a relatively frequent primary defrost cycle operation keeps most of the frost/ice off the exterior heat exchanger, and permits near optimum levels of continuous exterior air heat exchange, without having to run the system (as in a conventional defrost cycle) for any extended approximately 4-15 minute period (until the frost/ice has melted and/or until the liquid refrigerant exiting the exterior heat exchanger in the cooling mode is about 40° F.) about every 30-90 minutes, as is conventionally done.

Further, the relatively frequent primary defrost operation, as disclosed herein, is not hard on the compressor; does not provide enough time to create a significant charge imbalance between the interior and exterior heat exchangers; does not permit the interior air to go for any significantly long period without full available design heat being provided; permits the continuous provision of at least some moderate amount of heat (usually over 50% of the normal heat supply/return delta to the interior air) by the heat pump system alone during defrost cycle operation; and prevents any significant frost/ice build-up on both the exterior heat exchange tubing itself and on the exterior unit's outer protective screening (thereby enhancing the maximization of design exterior air heat exchange efficiencies).

The valve within the supplemental hot gas refrigerant transport line may remain shut and inoperative at all times when the outdoor air temperature is at least approximately 40-45° F., and/or when less than a threshold amount of frost/ice is on the exterior heat exchange tubing, as there may be no need for a defrost cycle operation. However, when outdoor temperatures fall below approximately 40-45° F., and/or when a threshold amount frost is detected on the exterior heat exchange tubing, a temperature sensor and/or a frost detection sensor, or the like, may be installed to activate both the primary and the entire defrost cycle operation as disclosed herein.

The approximately 20 second, plus or minus about 5 seconds, period for primary defrost cycle operation once about every seven minutes, in conjunction with the exterior fan in the exterior heat exchanger being turned off and disengaged for about a 20 second period (commencing about 5 seconds before the primary defrost cycle is terminated), all totaling about 35 seconds, as disclosed herein, may be an advantageous period of time. Testing has indicated that a shorter period of operation may not satisfactorily remove all frost/ice, and that a longer period of operation can excessively lower (by more than about 50% of normal interior heat supply/return temperature delta) the heat supply temperature to the interior air. The subject time periods for defrost cycle operation, as disclosed herein, when outside air temperatures are close to freezing and outdoor air humidity levels are around 85%, even with an approximate 45 second entire defrost period, will generally not lower the interior return/supply air temperature differential by any more than about 48% for a short period of time (typically for no more than about 20 seconds). Generally, when using a 35 second entire defrost period, the heat supply/return temperature delta to the interior air will not be lowered by any more than about 38%.

However, testing has indicated that it may be beneficial for the entire defrost cycle not to exceed approximately 49 seconds. The 49 second entire defrost cycle may be comprised of an approximate 29 second primary defrost cycle, in conjunction with the exterior fan being non-operative for a total period of about 25 seconds, with the 25 second non-operative exterior fan period commencing about 5 seconds before the end of the primary defrost cycle and extending to about 20 seconds after the end of the 29 second primary defrost cycle. If a longer entire defrost cycle is used, the heat supply/return temperature delta to the interior air may be lowered by more than about 50%.

Interestingly, while the exterior fan is generally always turned off and disengaged during a conventional defrost cycle, testing has demonstrated that leaving the exterior fan on and engaged during the defrost cycle as disclosed herein provides a material positive defrost time advantage. Here, the exterior fan is only disengaged after the frost is mostly melted/removed (about 5 seconds before the end of the primary defrost cycle) to significantly or entirely eliminate compressor peaking during the relatively brief normal heating mode operation recovery time.

In situations where humidity levels are higher than about 85% and/or where outside temperatures are below about 40-45° F., the subject defrost cycle as disclosed herein may need to be activated more frequently than once every approximate 7 minute period, as required by conditions. Alternately, in situations where humidity levels are lower than about 85% and/or where outside temperatures are above about 40-45° F., the subject defrost cycle as disclosed herein may need to be activated less frequently than once every approximate 7 minute period, as required by conditions.

Additionally, when the interior thermostat is satisfied, and when the outdoor air temperatures are less than approximately 40-45° F. or a threshold amount of frost is detected on the exterior heat exchanger, the system may be controlled to automatically switch to an approximate 20 second, plus or minus about 5 seconds, primary defrost cycle of operation, as disclosed herein, before the thermostat actually shuts the system down, regardless of when the last actual entire defrost cycle occurred, in the manner as herein disclosed. This helps eliminate any frost/ice on the exterior heat exchange tubing, so that when the interior thermostat again calls for heat, the system will start up with little to no ice/frost at all on the exterior heat exchanger. Further, by ending the heating mode of operation in a primary defrost cycle, no compressor peaking load will occur.

When the thermostat no longer calls for heat and therefore a final primary defrost mode of operation is executed, the fan in the exterior heat exchanger may be disengaged and shut off after about 20 seconds, plus or minus about 5 seconds, of primary defrost system operation, and the exterior fan would not be engaged and turned back on until the thermostat once again called for heating mode operation, at which point the fan may be engaged in a normal manner for standard heating mode operation.

Additionally, in an alternative final defrost cycle mode of operation, a primary defrost cycle mode of operation may be conducted, but with the interior fan disengaged and shut off during the entire final approximate 20 seconds, plus or minus about 5 seconds, of primary defrost cycle system operation, during which final approximate 20 second period, plus or minus about 5 seconds: the solenoid valve, or the like, within the new supplemental hot gas refrigerant transport line may be opened; the approximate 94% to 96% restriction within the consolidated vapor refrigerant transport line (exiting the exterior heat exchanger) may be engaged; the exterior fan may be disengaged (turned off) about 5 seconds before the approximate 20 second primary defrost cycle terminated; and the compressor would remain engaged (turned on) until the termination of the primary defrost cycle.

At the termination of any final defrost cycle mode of operation at the end of a period when the indoor thermostat had been satisfied: the solenoid valve, or the like, within the new supplemental hot gas refrigerant transport line may be closed; the approximate 94% to 96% restriction (as hereinafter more fully explained) within the consolidated vapor refrigerant transport line (exiting the exterior heat exchanger) may be disengaged (opened); and all of the system's remaining operating mechanical parts may be disengaged and turned off. Thus, the system may be in a proper condition for normal system start-up when the interior thermostat again called for heating mode operation.

(5) A Specially Sized Restriction to the Refrigerant Flow, when the System is Operating in the Defrost Cycle, in the Consolidated Vapor Refrigerant Transport Line Exiting the Exterior Heat Exchanger, in a Location that is Past the Exterior Heat Exchanger's Exiting Vapor Line Distributor, in the Direction of the Refrigerant Flow in the Heating Mode, but Before the Entrance to the Accumulator or Compressor:

Testing has demonstrated that some restriction, solely during the defrost cycle of operation as disclosed herein, in the common consolidated hot gas/vapor line, after (in the direction of the refrigerant flow in the heating mode), but relatively close to, the vapor line distributor on the exiting side of the exterior heat exchanger, causes the flow of temporary defrost cycle hot gas to slow down and transfer more heat to the frosted exterior heat exchange tubing. Further, providing such a restriction also serves to force more heat, via the hot gas refrigerant vapor exiting the compressor, into the interior heat exchanger during the defrost cycle periods of operation as disclosed herein.

It should be noted that compressor discharge line sizes are designed to accommodate a certain size range of compressors, and that cooler vapor suction lines to the compressor are also designed to accommodate a certain size range of compressors. Conventional sizing of compressor discharge and suction lines are well understood by those skilled in the art. For example, a two-ton compressor (24,000 BTUs) would typically have a ⅜ inch outside diameter refrigerant grade discharge line and a ¾ inch outside diameter refrigerant grade suction line.

Such a restriction may generally be between about 94% and 96% of the interior cross-section of the primary consolidated vapor refrigerant transport line, so that the restriction blocks about 94% to 96% of refrigerant flow through the consolidated vapor refrigerant transport line during defrost cycle operation, as disclosed herein. Testing has indicated that a larger restriction that further reduces refrigerant flow will decrease compressor suction pressures below preferable levels, and can also unnecessarily elevate the compressor's power draw when coming out of the defrost cycle. On the other hand, a smaller restriction that permits increased refrigerant flow will excessively increase refrigerant flow velocity through the exterior heat exchanger, thereby unnecessarily extending the operational defrost period, and also unnecessarily impairing interior air supply temperatures.

The restriction in the common consolidated hot gas/vapor line exiting the exterior heat exchanger in the heating mode of operation may be engaged during the defrost cycle of operation without restricting the flow of refrigerant vapor into the exterior heat exchanger during the normal air-conditioning (cooling) mode of operation.

An example of one way to engage the disclosed restriction, solely during the defrost cycle of operation, may be to place an electronic valve, or the like, in the segment of the common consolidated hot gas/vapor line, so that the electronic valve automatically engaged to provide the desired and calibrated disclosed flow restriction solely during periods of actual defrost cycle operation.

Another example of a way to engage the restriction, solely during the actual defrost cycle of operation as disclosed herein, may be to install a solenoid valve, or the like. The solenoid valve may open/close to either permit full flow during normal heat pump operation, or to block all flow in the said segment of the common consolidated hot gas/vapor line. A refrigerant transport by-pass line may be installed around the solenoid valve. The by-pass line may be sized to permit only approximately 4% to 6% of the maximum flow rate, based upon a cross-wise interior area of the common consolidated vapor refrigerant transport line exiting the exterior heat exchanger in the heating mode of operation. The by-pass line would remain fully open and therefore not impact operation of the system during the primary heating and cooling modes, when the solenoid valve was fully opened.

(6) A Sensor that Senses Either an Outdoor Temperature of Approximately 40-45° F., or Lower, or a Threshold Amount of Frost on the Exterior Heat Exchanger:

A sensor may be provided that detects a triggering condition for initiating defrost operations. The sensor may monitor the outdoor temperature, and may be programmed (or coupled to a controller that is programmed) to generate a "defrost on" signal when the outdoor temperature is at or below a temperature threshold, such as approximately 40-45° F. Alternatively, the sensor may be a frost sensor that generates a "defrost on" signal when a threshold amount of frost is detected on the exterior heat exchanger. Still further, the sensor may be a pressure sensor that generates a "defrost on" signal when a threshold pressure is detected. The subject sensor may be operably connected, via wiring or the like, to the defrost controller, as next described herein.

If a frost sensor is used, the area of interest for frost buildup is the exterior heat exchanger, and specifically the finned heat exchange tubing. If the exterior heat exchanger uses micro-channels, or the like, in lieu of finned tubing, the area of interest for frost buildup may be the micro-channels or other similar structure.

The threshold amount of frost may be a predetermined thickness, such as approximately 1/32 of an inch, covering the area of interest on the heat exchange finned tubing. Additionally or alternatively, the threshold amount of frost may be defined as visible frost covering approximately 33.3% of the exterior heat exchanger finned tubing.

A controller may be used to engage and disengage solenoid valves, electronic valves, fan motors, or the like, based upon at least one of temperature, pressure, and the presence of frost/ice. The controller may communicate by means of control wires or electronically transmitted signals.

(7) a Controller Device that Both Controls and Times the Operation of the Special Valve in the New Supplemental Hot Gas Refrigerant Transport Line and the Simultaneous Operation of the Valve Controlling the Restriction in the Consolidated Vapor Refrigerant Transport Line Exiting the Exterior Heat Exchanger, Such that when the Special Valve is Open, the Valve Controlling the Restriction in the Consolidated Vapor Refrigerant Transport Line is Engaged, and Such that when the Special Valve is Closed, the Valve Controlling the Restriction in the Consolidated Vapor Refrigerant Transport Line is Disengaged:

Control and timing devices may send appropriate electronic signals, based upon at least one of sensed temperatures, pressures, frost/ice thickness, and the like, to effectively engage and/or disengage electronically controlled valves, such as the special valve in the new supplemental hot gas refrigerant transport line, as described hereinabove, and such as the valve controlling the restriction in the consolidated vapor refrigerant transport line, as described hereinabove.

In a primary defrost cycle of operation, a controller device may both control and time the operation of the special valve in the supplemental hot gas refrigerant transport line and may simultaneously control the operation of the valve controlling the restriction in the consolidated vapor refrigerant transport line exiting the exterior heat exchanger, such that when the special valve in the supplemental hot gas line is open, the valve controlling the restriction in the consolidated vapor refrigerant transport line is engaged so that the restriction is engaged, and such that when the special valve in the supplemental hot gas line is closed, the valve controlling the restriction in the consolidated vapor refrigerant transport line is disengaged so that there is no restriction in the consolidated vapor refrigerant transport line.

The controller device may engage both the special valve in the new supplemental hot gas refrigerant transport line, and the valve controlling the restriction in the consolidated vapor refrigerant transport line exiting the exterior heat exchanger, only when the exterior air temperature is less than approximately 40-45° F., or when the threshold amount of frost/ice covers the exterior heat exchanger.

To control the primary defrost cycle, the controller engages both the special valve in the supplemental hot gas refrigerant transport line and the valve controlling the restriction in the consolidated vapor refrigerant transport line exiting the exterior heat exchanger for a primary defrost period of about 20 seconds, plus or minus about 5 seconds. The primary defrost cycle is repeated after a defrost cycle time, such as approximately seven minutes, of heat pump system operation.

Also, the controller engages both the special valve in the supplemental hot gas refrigerant transport line and the valve controlling the restriction in the consolidated vapor refrigerant transport line exiting the exterior heat exchanger, for about a 20 second, plus or minus about 5 seconds, period whenever the thermostat is satisfied, but immediately before the heat pump system is shut off, regardless of the time since the last primary and/or entire defrost cycle operation, whenever the exterior air temperature is less than approximately 40-45° F., and/or whenever a threshold amount of frost/ice is detected on the exterior heat exchanger. This helps insure there is no to minimal frost/ice on the exterior heat exchanger when the thermostat again calls for heat and the heat pump system is started back up in a conventional manner. Further, a primary defrost cycle operation, as disclosed herein, at the end of a heating mode operational cycle, places no peak power draw load on the compressor at all.

Additionally, as previously mentioned, in an alternative final defrost cycle mode of operation, when the interior thermostat was satisfied and called for the heat pump system to be turned off, a primary defrost cycle mode of operation may be conducted by the controller, but with the controller also controlling the disengagement of the interior fan during the entire final approximate 20 seconds, plus or minus about 5 seconds, of primary defrost cycle system operation, during which final approximate 20 second period, plus or minus about 5 seconds, the controller: would also call for the solenoid valve, or the like, within the new supplemental hot gas refrigerant transport line to be in an open position; would additionally call for the approximate 94% to 96% restriction within the consolidated vapor refrigerant transport line (exiting the exterior heat exchanger) to be engaged; would call for the exterior fan to be disengaged (turned off) about 5 seconds before the primary defrost cycle terminated; and would call for the operation of the compressor to continue until termination of the primary defrost cycle.

At the termination of any final defrost cycle mode of operation at the end of a period when the indoor thermostat had been satisfied, the controller: would call for the solenoid valve, or the like, within the new supplemental hot gas refrigerant transport line to be closed; the approximate 94% to 96% restriction within the consolidated vapor refrigerant transport line (exiting the exterior heat exchanger) to be disengaged (opened); both the exterior fan in the exterior heat exchanger and the interior fan in the air handler to remain off and disengaged; and all of the system's remaining operating mechanical parts (such as the compressor) to be disengaged and turned off. Thus, the system may be in a proper condition for normal system start-up when the interior thermostat again called for heating mode operation.

(8) Leaving Intact all of the Small Liquid Refrigerant Transport Capillary Tubing, the Small Liquid Line Distributor, the Consolidated Relatively Small Liquid Refrigerant Transport Line, and the Heating Mode Expansion Device, all Situate at the Exiting End of the Interior Heat Exchanger, in the Direction of Refrigerant Flow in the Heating Mode:

Testing has indicated that back pressure within the indoor air handler (with the back pressure extending to the supplemental hot gas refrigerant transport line) is exerted by leaving the small capillary tubes intact, by leaving the small liquid distributor intact, as well as by leaving the relatively small liquid refrigerant transport line intact and by leaving the conventional heating mode expansion device intact. This back pressure is advantageous in the subject defrost cycle as it tends to force more hot gas refrigerant vapor into the new supplemental hot gas refrigerant transport line that extends from the compressor primary hot gas refrigerant discharge line to the new and enlarged connecting segment of refrigerant transport tubing situated between the heating mode expansion device and the entering distributor to the exterior heat exchanger.

As a result of the subject advantageous back pressure, in conjunction with the herein disclosed unimpeded hot gas refrigerant flow into the finned heat transfer tubing, or the like, of the exterior heat exchanger during a defrost cycle of operation, and in conjunction with the herein disclosed restriction in the consolidated vapor refrigerant transport line exiting the exterior heat exchanger in the heating mode of operation, there is an ample supply of hot gas from the compressor to both vaporize at least one of most and all of liquid phase refrigerant within the exterior heat exchanger and to simultaneously promptly melt the frost/ice that has accumulated on the outside of the finned tubing, or the like, so that a minimum of normal interior heat supply is lost during the defrost cycle of operation.

(9) Turning the Fan in the Exterior Heat Exchange Unit Off and then Back on During Specific Time Periods During the Entire Defrost Cycle, all while Leaving the Fan in the Interior Heat Exchanger Fully Operative:

While the operation of the exterior fan in the exterior heat exchange unit could arguably be left on during the relatively short actual defrost cycle of operation (about 20 seconds, plus or minus about 5 seconds), since there will have been no significant frost/ice build-up on the exterior heat exchanger and airflow would still be augmented over the exterior heat exchange tubing, testing has demonstrated a net operational non-peaking advantage in disengaging the exterior fan's operation during a specific time period.

Namely, detailed testing has indicated that, while the exterior fan may always be engaged and operative during normal heat pump operation, turning the exterior fan off about 5 seconds before the initial approximate 20 second, plus or minus about 5 seconds, primary defrost cycle period (involving the solenoid valve and the restriction) ends, and then turning the exterior fan back on about 20 seconds, plus or minus about 5 seconds, after the exterior fan was turned off, will mitigate or eliminate any peaking of electrical power draw of the compressor during the both the entire defrost cycle and the defrost recovery cycle of system operation. (The defrost recovery cycle of operation is herein defined as the period of time it takes the system to regain normal operating refrigerant pressures, normal operating compressor power draw, and normal operating interior air heat supply/return temperature deltas after a defrost cycle was first initiated.)

The ability to reduce or eliminate compressor power peaks, as well as the ability to simultaneously eliminate the need for supplemental and extra heat (usually via expensive and power-consuming electric resistance heat), is highly advantageous for both the heat pump user, as electric bills will be low during the defrost cycle of operation, and for the electrical utility company supplying the power, as peaking concerns will be at least one of totally eliminated and significantly reduced during cold weather periods of heat pump system operation when defrost cycle system operation is required.

Testing has indicated that the adverse affect on the indoor heat loss during the actual primary and/or entire defrost cycle is greatest during the approximate 5 to 10 second period immediately after the primary defrost cycle period is disengaged. Prior to this approximate 5 to 10 second period, when utilizing the entire defrost system/cycle as disclosed herein, the normal indoor heat supply/return temperature delta diminishes (but typically by less than 50% of the pre-defrost cycle temperature differential between interior return and supply air temperatures), and after this approximate 5 to 10 second period, the supply/return heat delta will increase (usually within about 90 seconds) back up to about 98% of full capacity, and shortly thereafter back up to full capacity.

Further, it should be noted that, in conjunction with all the above, the interior fan within the interior heat exchanger/air handler may be left on and fully operational (in its normal speed mode of operation) during the entire defrost cycle as disclosed herein. The entire defrost cycle as disclosed herein would typically encompass no more than a total of about forty-five seconds, although a maximum acceptable period of about 49 seconds could be provided without any more than about a 50% very temporary reduction in the interior supply/return heat delta. Such a typical 45 second entire defrost cycle time period may be comprised of an initial approximate twenty-five second primary defrost cycle period (when the solenoid valve was fully opened (engaged) in the new supplemental hot gas refrigerant transport line, and when the approximate 94% to 96% restriction was simultaneously imposed (engaged) within the consolidated vapor refrigerant transport line exiting the exterior heat exchanger), plus the maximum approximate twenty-five second period when the exterior fan was turned off, which exterior fan non-operational period extends from about 5 seconds prior to cessation of the primary defrost cycle and for about 20 seconds thereafter.

To be more precise, testing has indicated that to avoid compressor power draw in excess of its normal operational power draw (i.e., "peaking"), and to simultaneously minimize interior heat supply degradation, during an approximate 20 second primary defrost period, the exterior fan may be disengaged about 15 seconds after the primary defrost cycle was initiated, and re-engaged about 20 seconds later.

Somewhat similarly, testing has indicated that to avoid peaking and to simultaneously minimize interior heat supply degradation, during an approximate 25 second primary defrost period, the exterior fan may be disengaged about 20 seconds after the primary defrost cycle was initiated, and re-engaged about 25 seconds later. The re-engaged, the fan may be immediately returned to its normal operating speed and need not slowly ramp back up, as it might otherwise be programmed to do when the entire system was initially engaged/turned on by the thermostat, absent being in the midst of any entire defrost cycle mode of operation. The above-noted controller, or a separate, dedicated fan controller, may control the fan motor in the exterior heat exchange unit so that the fan disengages and re-engages as disclosed herein.

If the indoor thermostat is satisfied, as previously mentioned, the defrost cycle may still be engaged before the heat pump system is turned off when the outdoor temperature is less than approximately 40-45° F. and/or when a threshold amount of frost/ice is detected on the exterior heat exchanger tubing, thereby to provide a frost-free exterior heat exchanger upon the next system start-up. However, in such event, when the indoor thermostat has been satisfied, then even though the fan would still be turned off about 5 seconds before the initial approximate 20 second, plus or minus about 5 seconds, primary defrost cycle period (involving the solenoid valve and the restriction) ends, the exterior fan would not be turned back on until the indoor thermostat again called for heat in the normal mode of system start-up. In such event, the exterior fan would only be turned back on and re-engaged in a normal fashion by the thermostat when the thermostat again called for normal heating mode operation.

Further, it should be noted that, in conjunction with all the above, the interior fan within the interior heat exchanger/air handler may be left on and fully operational, in its normal speed mode of operation, during the entire defrost cycle as disclosed herein. In some embodiments, the entire defrost cycle as disclosed herein would encompass a total of about 35 seconds, which includes a primary defrost period of approximately 20 seconds and a fan disengage period of approximately 20 seconds, with the fan disengage period beginning approximately 5 seconds before the primary defrost period ends.

To be more precise, to avoid "peaking" and to simultaneously minimize interior heat supply degradation, testing has indicated that, during an approximate 20 second primary defrost period, the exterior fan may be disengaged about 15 seconds after the primary defrost cycle was initiated, and re-engaged about 20 seconds after the fan was turned off. This standard entire defrost cycle system sequence may be advantageous, as no compressor peaking results, in conjunction with low adverse affects on interior air temperature supply/return deltas.

Somewhat similarly, testing has indicated that to avoid "peaking" and to simultaneously minimize interior heat supply degradation, during an approximate 5 second longer 25 second primary defrost period, the exterior fan may be disengaged about 20 seconds after the primary defrost cycle was initiated, and re-engaged about 25 seconds after the fan was turned off. This sequence may also avoid compressor peaking, and may further provide the next to lowest adverse affect on interior air temperature supply/return deltas, all while providing an extra 5 second primary defrost cycle in areas where frost is more of a concern than normal.

Testing has indicated that utilization of an approximate 15 second primary defrost period, with the exterior fan being disengaged about 10 seconds after the primary defrost cycle was initiated, and re-engaged about 15 seconds after the fan was turned off, will usually result in no compressor peaking, but can sometimes result is minimal compressor peaking (typically no more than about 4% of the compressor's normal power draw for a minimal period of time, usually no more than about 5 or 10 seconds). However, such a 15 second primary defrost period, within an approximate 25 second entire defrost cycle, has the advantage of providing a very low adverse impact upon the interior air temperature supply/return deltas. Because some minimal compressor peaking could occur, unless minimal impact on interior air temperature supply/return deltas is of primary importance, this sequence may be less advantageous than the two sequences described above.

Also, an approximate 15 second primary defrost period, with the exterior fan being disengaged about 10 seconds after the primary defrost cycle was initiated, and re-engaged about 15 seconds after the fan was turned off, will not remove quite as much frost accumulation as the aforesaid approximate 20 second primary defrost period if heavier than normal frost accumulation is a concern. The potential of compressor peaking issue in such an entire defrost cycle can be at least one of further mitigated and eliminated by providing a total approximate 20 second off period for the exterior fan, where the exterior fan is initially turned off about 5 seconds before termination of the primary 15 second defrost cycle, and where the fan remains off for about another 15 seconds thereafter (instead of remaining off for only another 10 seconds thereafter).

Additionally, as previously mentioned, in an alternative final defrost cycle mode of operation, when the interior thermostat was satisfied and called for the heat pump system to be turned off, a primary defrost cycle mode of operation may be conducted, but with both the controller controlling, via signals through respective control wires, or the like, the disengagement of the interior fan during the entire final approximate 20 seconds, plus or minus about 5 seconds, of primary defrost cycle system operation, during which final approximate 20 second period, plus or minus about 5 seconds the controller: would also call for the solenoid valve, or the like, within the new supplemental hot gas refrigerant transport line to be in an open position; would additionally call for the approximate 94% to 96% restriction within the consolidated vapor refrigerant transport line (exiting the exterior heat exchanger) to be engaged; would terminate operation of the exterior fan about 5 seconds prior to the end of the primary defrost cycle; and would call for operation of the compressor to continue.

At the termination of any such final defrost cycle mode of operation at the end of a period when the indoor thermostat had been satisfied, the controller: would call for the solenoid valve, or the like, within the new supplemental hot gas refrigerant transport line to be closed; the approximate 94% to 96% restriction within the consolidated vapor refrigerant transport line (exiting the exterior heat exchanger) to be disengaged (opened); and all of the system's remaining operating mechanical parts (such as the compressor) to at least one of remain off and disengaged and to be disengaged and turned off Thus, the system may be in a proper condition for normal system start-up when the interior thermostat again called for heating mode operation.

(10) Adding an Additional Refrigerant Charge Amount to the System that is Approximately Equal to the Total Amount of Liquid Phase Refrigerant Necessary to Fill the Additional Calculated Interior Content Area within Both the New and the Larger-Sized Entering Liquid Refrigerant Transport Tubing on the Entering Side of the Exterior Heat Exchanger, which Both New and Larger-Sized Tubing is Situated Between the Heating Mode Expansion Device, the New Special Valve in the New Supplemental Hot Gas Refrigerant Transport Line, and the Ending Point (in the Direction of Refrigerant Flow in the Heating Mode) of the Former Small Capillary Tubing that Connected with the Finned Refrigerant Transport Tubing within the Exterior Heat Exchanger:

Testing has indicated that implementation of the one or more of the aforesaid features may result in a refrigerant charge deficiency, causing excessively high compressor discharge temperatures and/or a reduction in system operational efficiencies. Accordingly, an appropriate amount of additional charge may be added to the heat pump system to compensate for the larger sizing of the capillary tubing, liquid distributor, and consolidated liquid refrigerant transport line segment, and the addition of the new supplemental hot gas refrigerant transport line.

Such additional charge may be comprised of the liquid refrigerant volume amount that is approximately equal to the total of: the additional calculated interior content of liquid phase refrigerant within the new larger sized replacement tubing that is over and above the former calculated interior liquid phase refrigerant content of the former smaller capillary tubing being replaced; the additional calculated interior content of liquid phase refrigerant that is over and above the former calculated interior liquid phase refrigerant content of the former smaller entering liquid refrigerant distributor being replaced; the additional calculated interior content of liquid phase refrigerant that is over and above the former interior liquid phase refrigerant content of the former segment of consolidated smaller liquid refrigerant transport line between the heating mode expansion device and the distributor to the exterior heat exchanger that has been replaced with a refrigerant transport tube that is approximately the same size as the compressor's hot gas discharge line; and the additional calculated interior content of liquid phase refrigerant that is within that segment of the new supplemental hot gas refrigerant transport line (that is specially sized to be about the same size as the compressor's hot gas discharge line) that extends from the new special valve (a solenoid valve, or the like) to the common refrigerant transport line segment situated between the heating mode expansion device and the distributor to the entrance of the exterior finned tubing, in the direction of refrigerant flow in the heating mode.

(11) Controller Frost Sensor Option:

While the basics of the subject defrost, no peak, system design have been disclosed hereinabove, a system design option may incorporate the hereinabove described disclosures, but instead of engaging the approximate 20 second primary defrost system about once every seven minutes, the entire defrost system cycle may be engaged as follows:

The entire system defrost cycle may be engaged for only as long as necessary to melt the frost/ice on the exterior heat exchanger's heat exchange tubing, not to exceed an approximate 49 second period of time (so as not to unduly impair indoor supply heat levels). The "as long as necessary" period, as an example, could be comprised of only a 10 second primary defrost cycle, plus only a 15 second total exterior fan disengagement period, with the fan disengagement period commencing about 5 seconds before the primary defrost cycle was over (terminated and disengaged), which all together would encompass a total 20 second entire defrost cycle.

As previously mentioned, as used herein, a "primary" defrost cycle means the period of time when the solenoid valve, or the like, in the new supplemental hot gas refrigerant transport line may be opened, which may be about the same time as the restriction, via an electronic valve, or the like, may be engaged in the consolidated vapor refrigerant transport line exiting the exterior heat exchanger. As used herein, an "entire" defrost cycle means the period of time, when the interior thermostat continues to call for heat, inclusive of the primary defrost cycle operation in conjunction with the time period the fan in the exterior heat exchange unit is disengaged and turned off.

The approximately 49 second maximum time period may be comprised of an approximately 29 second maximum primary defrost cycle time period, and an additional approximately 20 seconds thereafter. The additional approximate 20 second portion of the total entire defrost cycle may be comprised of the 20 second remainder of the total approximate maximum 25 second period during which the exterior fan may be disengaged (turned off), with the 20 second remainder period commencing about 5 seconds before the primary defrost cycle terminated (when the exterior fan was first turned off and disengaged during the entire defrost cycle).

During an entire defrost cycle: a primary defrost cycle of about 10 seconds, in conjunction with a total non-operational exterior fan period of about 15 seconds total would normally be an approximate minimum; and a primary defrost cycle of about 29 seconds, in conjunction with a total non-operational exterior fan period of about 25 seconds total would normally be a maximum. If the exterior fan is disengaged for less than about 15 seconds (and more safely for about 20 seconds), the compressor could experience power peaking. If the entire defrost cycle lasted for more than about 49 seconds, the interior heat loss could drop beyond about 50% of the supply/return delta.

Generally, to help insure there are no compressor power peaking issues, as well as to help insure there is no excessive interior heat supply loss, an approximate 20 second time period for the exterior fan to be disengaged may be utilized when any primary defrost cycle time period (even less than about 15 seconds) is utilized, with the subject 20 second exterior fan off period commencing about 5 seconds before the primary defrost cycle terminates, and with the exterior fan remaining off and disengaged for another approximate 15 second period after the primary defrost cycle terminated, so long as the interior thermostat was still calling for heating mode operation.

Thus, in summary, for an optimum controller frost/ice sensor option, the entire defrost system cycle may be for a period of time that is only as long as necessary to melt the frost/ice (not shown) on the exterior heat exchanger's heat exchange finned tubing, not to exceed an approximate 49 second total period of time, and not to be less than an approximate 20 second total time period of time. However, as also previously explained, an approximate total of 20 seconds may generally be utilized as the time period for the exterior fan motor to be disengaged during an entire defrost cycle of any period of time within the approximate 49 second maximum time period.

Further, because the impact to the heat pump system and to the interior supply air temperature is so relatively minimal, via the entire defrost cycle as disclosed herein, the entire defrost cycle may be engaged and implemented as often as necessary, whenever any predetermined amount of minimal (with 1/32 of an inch thick and/or frost being visible on no more than about one-third of the exterior heat exchanger's finned tubing being previously set forth herein as examples only) frost/ice is detected, by a frost/ice sensor, or the like, on the exterior heat exchanger's heat exchange finned tubing.

By being able to operate the subject entire defrost cycle only as often as necessary, there will never be any significant frost/ice build up on the exterior heat exchange tubing, which will help insure exterior air to refrigerant heat exchange is always at, or close to, an optimum. Further, by defrosting only when necessary, the need to force a conventional air-source heat pump system into a defrost cycle at least once every approximate 30 to 90 minutes, when it actually may not be necessary due to low humidity levels, or the like, is eliminated, thereby saving in system operational costs, as well as saving unnecessary wear and tear on the reversing valve and compressor.

The defrost system disclosed herein may also be used to defrost refrigeration systems to keep frosting/ice off of interior cooling coils, or the like. Additionally, the defrost system may also be used in a variable refrigerant volume ("VRV"), or the like, heat pump system design, to increase defrost mode operational efficiencies and/or reduce electrical power draw peaking concerns.

BRIEF DESCRIPTION OF THE DRAWINGS

For a more complete understanding of this disclosure, reference should be made to the embodiments illustrated in greater detail on the accompanying drawings, wherein:

FIG. 1 is a schematic side view, not drawn to scale, of an air-source heat pump system, operating in the heating mode, inclusive of a frequent short-cycle zero peak heat pump defrost system design.

It should be understood that the drawings are not necessarily to scale and that the disclosed embodiments are sometimes illustrated diagrammatical and in partial views. In certain instances, details which are not necessary for an understanding of this disclosure or which render other details difficult to perceive may have been omitted. It should be understood, of course, that the disclosures herein are not limited to the particular embodiments illustrated herein, and that various changes may be made and/or equivalents may be substituted for elements thereof without departing from the scope of the disclosures herein. In addition, modifications may be made to adopt a particular situation or material to the teachings of the disclosures without departing from the essential scope thereof. It is intended that the disclosures herein not be limited to the particular embodiments disclosed herein as necessarily being the best mode contemplated for carrying out the disclosures, but that the disclosures herein will include all embodiments falling within the scope of the claims herein.

DETAILED DESCRIPTION

The following detailed description is of the best presently contemplated mode of carrying out the subject matter disclosed herein. The description is not intended in a limiting sense, and is made solely for the purpose of illustrating the general principles of this subject matter. The various features and advantages of the present disclosure may be more readily understood with reference to the following detailed description taken in conjunction with the accompanying drawings.

FIG. 1 illustrates an air-source heat pump system operating in the heating mode and configured with a frequent short-cycle zero peak heat pump defrost system. During normal heat pump system operation, a compressor 1 sends a hot discharge gas/vapor refrigerant (the directional flow of the refrigerant is indicated by straight arrows 2), through the primary hot gas refrigerant discharge line 3 (with a solenoid valve 18, or the like, situated within a supplemental hot gas refrigerant transport line 17, being in a closed position for normal heat pump system operation, although the solenoid valve 18 is shown herein in an open position as used in a defrost cycle as described below), which primary hot gas line 3 is shown as running through a structure wall 4 into an interior heat exchanger 5. An interior heat exchanger 5 is typically referred to as an air handler. The interior heat exchanger 5 may include a cooling mode expansion device 26 (which is by-passed in the heating mode, often via an internal by-pass means incorporated into the cooling mode expansion device 26), an entering vapor refrigerant transport line distributor 27, finned refrigerant transport tubing 11 (used for interior air 9, with air 9 not shown but indicated by directional wavy arrows 9, to refrigerant heat transfer), and a interior fan 28.

During normal heat pump system operation, the refrigerant rejects heat into the interior air 9 circulating through the interior heat exchanger 5 by means of refrigerant to air heat exchanger via the refrigerant circulating through the finned refrigerant transport tubing 11, or the like. As heat is rejected into the interior air 9, the hot gas/vapor refrigerant cools and condenses into a liquid phase refrigerant fluid. The liquid phase refrigerant exits the air handler 5 through very small refrigerant transport capillary tubing 29 (capillary tubing 29 is often has about a ⅛" outside diameter), into a small liquid refrigerant distributor 30, operably attached to a relatively small consolidated liquid refrigerant transport line 6 (the liquid line 6 is referred to as a consolidated liquid line 6 because it is the single line 6 carrying liquid phase refrigerant exiting from distributed liquid refrigerant transport smaller capillary tubes 29 that extend from the distal end 31 of the typically finned refrigerant transport heat exchange tubing 11 within the air handler/interior heat exchanger 5). The relatively small consolidated liquid refrigerant transport line 6 (often having about a ⅜" outside diameter in a two ton heat pump system, as an example) extends through the structural wall 4, in the direction of the refrigerant flow in the heating mode, with the refrigerant fluid next traveling into a heating mode expansion device 7.

The heating mode expansion device 7 may be a pin restrictor, an automatic expansion valve, an electronic expansion vale, or the like. The heating mode expansion device 7 acts to both reduce the pressure and the temperature of the circulating refrigerant, so that as the refrigerant next principally travels into the exterior heat exchanger 8, where the circulating refrigerant absorbs heat from the exterior/outside air 9.

Just before initially entering the exterior heat exchanger 8, after already having exited the heating mode expansion device 7, the refrigerant is shown herein as traveling through a connecting segment of refrigerant transport tubing 15 that transports the refrigerant from the expansion device 7 to an entering distributor 10. The connecting segment of refrigerant transport tubing 15 is about the same size (about the same size herein meaning outside dimension, or "O.D." and inside dimension, or "I.D.", as opposed to the same length) as the hot gas refrigerant discharge line 3 exiting the compressor 1. However, although not shown herein in any specific scale, in a conventional heat pump system, the connecting segment of refrigerant transport tubing 15 would actually be about the same size as both the hot gas refrigerant discharge line 3 and the relatively small liquid refrigerant transport line 6 (shown herein as positioned between the small liquid refrigerant distributor 30, within the interior air handler/heat exchanger 5, and the heating mode expansion device 7).

As explained hereinabove, it is advantageous to provide the particular connecting segment of refrigerant transport tubing 15 in about the same size as the hot gas refrigerant discharge line 3 exiting the compressor 1 to insure an appropriate amount of hot vapor refrigerant freely flows into the exterior heat exchanger 8 absent any undue restriction on the entering end of the exterior heat exchanger 8, in the direction of refrigerant flow in the heating mode. If the particular connecting segment of refrigerant transport tubing 15 is either too large or too small, design defrost operating conditions can be impaired to some degree.

Next, the connecting segment of refrigerant transport tubing 15 transports the refrigerant into an entering distributor 10, which first distributes the refrigerant flow into respective multiple distributed moderately sized refrigerant transport lines 16 (with only two such lines 16 shown as an example herein), which, other than in the subject defrost system design/disclosure, are otherwise typically comprised of multiple smaller sized capillary tubes (not shown herein), often having about ⅛" outside diameter, typically being the same size as the very small refrigerant transport capillary tubing 29 shown near the bottom of the interior heat exchanger 5.

However, the conventionally sized, smaller capillary tubes have been replaced with relatively larger sized refrigerant transport tubing/lines 16, so as not to impede the flow of hot refrigerant vapor from the compressor 1 into the exterior heat exchanger 8, when the system is operating in a defrost cycle.

When operating in a defrost cycle, hot discharge refrigerant gas, exiting the compressor 1, travels through the supplemental hot gas refrigerant transport line 17, which may be sized to be about the same size as the primary hot gas discharge line 3. The supplemental hot gas refrigerant transport line 17 extends from the primary hot gas refrigerant transport line 3, with the new line's 17 extension exiting from the primary hot gas line 3 extending from the compressor 1 or oil separator (not shown), and extends to the connecting segment of refrigerant transport tubing 15, which connecting segment 15 is situated between the heating mode expansion device 7 and the entering distributor 10 to the entrance of the exterior heat exchanger 8.

The exterior heat exchanger typically contains finned refrigerant transport tubing 11 (only segments of the finned tubing 11 within the exterior heat exchanger 8 are shown herein as an example) utilized for exterior air to refrigerant heat exchange purposes within the air-source heat pump's exterior heat exchanger 8.

An oil separator (not shown herein, as most heat pump systems do not utilize oil separators) is well understood by those skilled in the art, and, if shown, the oil separator may be situated in the primary hot gas refrigerant discharge line 3 between the compressor 1 and the supplemental hot gas refrigerant transport line 17, so that compressor oil (not shown) may be removed and re-circulated back to the compressor 1 before traveling through at least one of the supplemental hot gas refrigerant transport line 17 and the interior heat exchanger/air handler 5.

Here, the supplemental hot gas refrigerant transport line 17 is shown with an open solenoid valve 18, or the like, to permit full hot gas refrigerant flow through the supplemental hot gas refrigerant transport line 17 when the system is operating in a defrost cycle, as shown herein. The combination of the normal refrigerant flow restriction imposed by the very small refrigerant transport capillary tubing 29, the small liquid refrigerant distributor 30, and the relatively small liquid refrigerant transport line 6 exiting the interior air handler 5, all in conjunction with the heating mode expansion device 7, forces an appropriate design amount of hot gas refrigerant from the compressor 1 through the supplemental hot gas refrigerant transport line 17, through the entering distributor 10 to the exterior heat exchanger 8, and into the exterior heat exchanger's 8 finned refrigerant transport tubing 11, to effectively and quickly melt frost/ice on the finned heat exchange refrigerant transport tubing 11, or the like, within the exterior heat exchanger 8.

Although not shown herein in detail, examples of moderately sized finned refrigerant heat transport tubing 11 are shown within the exterior heat exchanger 8. The finned refrigerant heat transport tubing 11 is typically coiled around the center interior of the exterior heat exchanger 8, with the compressor 1 and accumulator 12 typically being situated within the otherwise empty center of the exterior heat exchanger 8. Here, for ease of demonstration and example purposes only, the compressor 1 and the accumulator 12 are shown as situated outside of the exterior heat exchanger 8, which would normally not be the case. The accumulator 12 may store extra liquid phase refrigerant, helping to prevent liquid phase refrigerant from entering and slugging the compressor 1.

Normally, in the heating mode, refrigerant enters the exterior heat exchanger 8 through an entering small sized entering distributor (not shown herein, but typically the same size as the exiting small liquid refrigerant distributor 30 as shown in the interior air handler 5) and then through the previously mentioned small capillary tubes (not shown herein, but typically the same size as the very small refrigerant transport capillary tubing 29 as shown in the interior air handler 5), next traveling into the moderately sized finned tubing 11. As the cooled and expanded refrigerant circulates through the multiple moderately sized finned tubing 11, it acquires heat from the outside air 9, which airflow is augmented by an exterior fan 13, normally situated at the center top portion of the exterior heat exchanger 8. The exterior fan augmented airflow over the finned tubing 11 within the exterior heat exchanger 8 provides a continuous supply of heat, naturally contained within and transferred from the exterior air to the colder refrigerant entering the exterior heat exchanger 8.

As the natural heat contained within the outside air is absorbed by the colder refrigerant circulating within the exterior heat exchanger 8, the refrigerant is heated and phased-changed into a vapor. The vapor phase refrigerant traveling through the moderately sized finned tubing 11 exits the respective moderately sized finned tubing 11, traveling though a standard and conventional consolidated vapor line exiting distributor 20 (in the heating mode). The vapor line exiting distributor 20 operably connects the unfinned exiting ends 32 of the multiple respective moderately sized finned tubing 11 within the exterior heat exchanger 8 with and to a consolidated vapor refrigerant transport line 14 exiting the exterior heat exchanger 8.

Normally, the consolidated vapor refrigerant transport line 14 next carries the mostly vapor phase refrigerant directly to the accumulator 12. Thereafter, the mostly vapor phase refrigerant exits the accumulator 12 and is suctioned into the compressor 1, where the refrigerant flow process is repeated and the now compressed and hot refrigerant vapor is normally directed, through the primary hot gas vapor refrigerant discharge line 3 into the interior heat exchanger/air handler 5 to provide heat to the interior air.

However, at the entrance to the exterior heat exchanger 8 (in the heating mode), the conventionally sized, relatively small liquid distributor and liquid refrigerant transport capillary tubes (typically about ⅛" outside diameter) are shown as having been replaced with a larger sized entering distributor 10 and with moderately sized distributed respective un-finned refrigerant transport tubing/lines 16. The moderately sized distributed respective un-finned refrigerant transport tubing/lines 16 may be about the same size as the actual size of the finned refrigerant transport tubing 11, or the like, within the exterior heat exchanger 8. Typically, such finned tubing 11 is comprised of approximately ⅜" outside diameter refrigerant grade finned tubing 11 for residentially sized air-source heat pumps, with commercial units having larger sized tubing.

However, when the normally smaller refrigerant transport tubing sizes in the presently shown larger sized connecting segment of refrigerant transport tubing 15, in the presently shown entering distributor 10, and in the presently shown respective moderately sized un-finned refrigerant transport lines, are replaced as disclosed herein with the larger refrigerant transport tubing sizes as disclosed herein, testing has indicated that an additional amount of refrigerant charge may be added to the system.

The additional refrigerant charge may be approximately equal to the additional calculated interior area content of liquid phase refrigerant both within the new larger sized refrigerant transport tubing (all situated between the heating mode expansion device 7, the respective points 36 where the respective multiple distributed moderately sized refrigerant transport lines 16 connect with the finned refrigerant transport tubing 11 within the exterior heat exchanger 8, and the connecting point 37 where the supplemental hot gas refrigerant transport line 17 connects with the connecting segment of refrigerant transport tubing 15), and within a certain segment (between the solenoid valve 18 and the said connecting point 37) of the new supplemental hot gas refrigerant transport line 17.

More specifically, the additional refrigerant charge is the total charge: that is over and above the calculated interior area liquid phase refrigerant content of the former smaller capillary tubing (not shown) that have been replaced with the larger respective moderately sized un-finned refrigerant transport lines 16; that is over and above the interior liquid phase refrigerant content of the former smaller entering distributor (not shown) that has been replaced with the larger entering distributor 10; that is over and above the interior liquid phase refrigerant content of the former segment of a smaller consolidated liquid refrigerant transport line size (not shown) as situated between the heating mode expansion device 7 and the entering distributor 10 to the exterior heat exchanger 8 that has been replaced with a connecting segment of refrigerant transport tubing 15 that is approximately the same size as the compressor's 1 hot gas discharge refrigerant transport line 3; and that also includes the total new liquid phase refrigerant content of that certain segment of the new supplemental hot gas refrigerant transport line 17 that is situated between the solenoid valve 18 and the said connecting point 37 of the new supplemental hot gas refrigerant transport line 17 with the connecting segment of refrigerant transport tubing 15.

Another way to describe the additional refrigerant charge, as an example, may be that refrigerant charge added to the heat pump system that is approximately equal to the total amount of liquid phase refrigerant necessary to fill the additional calculated interior content area within both the new and the larger-sized entering liquid refrigerant transport tubing on the entering side of the exterior heat exchanger 8, which both new and larger-sized tubing is comprised of all the new and of all the larger-sized refrigerant transport tubing situated between the heating mode expansion device 7, the new special valve 18 (herein shown as an open solenoid valve 18) in the new supplemental hot gas refrigerant transport line 17, and the ending points/respective points 36 (in the direction of refrigerant flow in the heating mode) of the former small capillary tubing (not shown) that connected with the finned refrigerant transport tubing 11 within the exterior heat exchanger 8.

By removing the conventional smaller refrigerant transport line restrictions between the hot gas discharge line 3 and the finned tubing 11 within the exterior heat exchanger 8, a full design and appropriate amount of hot refrigerant gas is both pulled and forced into the exterior heat exchanger 8. The hot refrigerant gas is pulled into the exterior heat exchanger 8 by the suction of the compressor 1, and is simultaneously forced into the exterior heat exchanger by the back-pressure created by the aforesaid combination of smaller capillary tubes 29 and small liquid refrigerant distributor 30 within the interior heat exchange/air handler 5, all in conjunction with the relatively small liquid refrigerant transport line 6 and the heating mode expansion device 7, which are all respectively left intact and unchanged, as normally designed. All of the aforesaid smaller capillary tubes 29, the small liquid refrigerant distributor 30, the relatively small liquid refrigerant transport line 6, and the heating mode expansion device 7, all being within and/or near to the interior heat exchange/air handler 5, and are intentionally left unchanged and as normally designed to help exert an appropriate amount of back-pressure to force an appropriate amount of hot gas refrigerant through the supplemental hot gas refrigerant transport line 17 during the defrost mode of operation, as disclosed herein.

During the defrost cycle, as disclosed herein, the hot refrigerant gas exiting the compressor 1 partially travels through the interior heat exchanger 5, as explained, and also partially travels through the supplemental hot gas refrigerant transport line 17, as also explained. After traveling through the supplemental hot gas refrigerant transport line 17, the hot gas interacts with cooled and expanded refrigerant exiting the heating mode expansion device 7. However, via the uninhibited hot gas refrigerant flow into the finned tubing 11 within the exterior heat exchanger 8, in conjunction with the now somewhat reduced condensed liquid phase refrigerant flow rate out of the interior heat exchanger 5 (the flow rate is reduced because a portion of the hot gas refrigerant has been diverted into through the supplemental hot gas refrigerant transport line 17 for defrosting purposes), the hot refrigerant gas traveling into the connecting segment of refrigerant transport tubing 15, situated between the heating mode expansion device 7 and the entering distributor 10 to the exterior heat exchanger 8, is of sufficient quantity to at least one of mostly and totally both vaporize the liquid phase refrigerant exiting the interior heat exchanger 5 as well as to effectively and quickly melt the frost/ice that has accumulated/formed on the finned refrigerant transport tubing 11, or the like, within the exterior heat exchanger 8, all without creating any excessive refrigerant condensation within the exterior heat exchanger 8 (thereby eliminating the need for some portion of the compressor's hot discharge refrigerant gas to be inefficiently diverted to the accumulator 12). However, in order to further provide an optimum amount of heat within both the interior heat exchanger 5, to still provide maximum available interior heating during defrost cycle operation, and to simultaneously provide enough heat to the exterior heat exchanger 8 to both quickly melt the frost/ice and to avoid premature excessive vapor refrigerant condensation within the exterior heat exchanger 8, testing has indicated that a restriction may advantageously be placed within the segment of the consolidated vapor refrigerant transport line 14 situated between the exiting vapor line distributor 20 from the exterior heat exchanger 8 and the accumulator 12. Further, the restriction may be appropriately sized to be optimally effective.

Testing has indicated that an optimum size for the subject restriction is approximately 94-96% of the interior cross-sectional area of the primary consolidated vapor refrigerant transport line 14. Two respective examples are respectively shown herein as ways to provide the approximately 94-96% restriction. However, in reality, only one such example would actually be utilized, as only one such restriction is necessary.

A first exemplary embodiment is shown as an electronic valve 21, or the like, that, when engaged (as shown herein), restricts the interior area of the primary consolidated vapor refrigerant transport line 14 by the approximately 94-96% cross-wise interior area. The electronic valve 21 is operably connected to a controller 22, or the like, by means of a control wire 23, or the like.

A second exemplary embodiment is shown as a closed solenoid valve 24, or the like, that completely blocks the primary consolidated vapor refrigerant transport line 14, but that is engaged and blocks the vapor line 14 only in the defrost mode in conjunction with a closed solenoid valve 24 by-pass line 25, which by-pass line 25 is sized small enough to solely permit between an approximate four to six percent flow rate of the total interior cross-wise area of the consolidated vapor refrigerant transport line 14 through the by-pass line 25 when the solenoid valve is fully closed (as shown herein) in the defrost mode of operation. The subject by-pass line 25 can remain fully open during normal system operation, as the subject by-pass line 25 remaining open will hurt nothing. However, when the defrost cycle is ended, the closed solenoid valve 24, or the like, within the vapor line 14 would fully open. The subject closed solenoid valve 24, or the like, may be operated by controller 22, or the like, to which it may be operably connected by a control wire 23, or the like.

To effect a primary defrost cycle, testing has indicated that it may be advantageous to engage and open the solenoid valve 18 (shown herein in an open position and situated within the supplemental hot gas refrigerant transport line 17, with the open solenoid valve 18 located proximal to the primary hot gas refrigerant discharge line 3 from the compressor 1 to avoid a dead area of non-working refrigerant when the system is not operating in a defrost mode), and to simultaneously engage the restriction in the consolidated vapor refrigerant transport line 14 for a typical period of about 20 seconds, plus or minus about 5 seconds, when the exterior air temperature is less than approximately 40-45° F. or when a threshold amount of frost/ice is present on the exterior heat exchanger finned tubing 11.

Testing has indicated the disclosed primary defrost cycle may be engaged, in the manner as disclosed herein, about once every seven minutes when the exterior air 9 temperature is less than approximately 40-45° F., or when a threshold amount of frost/ice is present on the finned tubing 11, all whenever outdoor relative humidity levels are about 85%. Depending on outdoor air temperature and outdoor relative humidity levels, the 7 minute period between defrost cycles may be either shortened or extended as necessary. For example, when outdoor air temperatures are near freezing and/or when outdoor relative humidity levels are higher than about 85%, the 7 minute interval between primary defrost cycles may be shortened as necessary, and when outdoor air temperature is approximately 40-45° F. and outdoor relative humidity levels are lower than about 85%, the 7 minute interval between primary defrost cycles may be lengthened as appropriate.

As described above: the full and unimpeded flow of hot gas refrigerant from the compressor 1 into the exterior heat exchanger 8 via the supplemental hot gas refrigerant transport line 17 (that is about the same size as the primary hot gas refrigerant discharge line 3); in conjunction with the back pressure within the indoor air handler 5 (with the back pressure extending to the supplemental hot gas refrigerant transport line 17) exerted by leaving the small capillary tubes 29 intact, by leaving the small liquid distributor 30 intact, as well as by leaving the relatively small liquid refrigerant transport line 6 intact and by leaving the conventional heating mode expansion device 7 intact; in conjunction with the addition of a special restriction that restricts about 94-96% of the flow through the consolidated vapor refrigerant transport line 14; provides an effective and relatively quick primary defrost means.

The described combination of leaving the smaller liquid line capillary tubing 29 within the interior heat exchanger/air handler 5 intact, with leaving the small liquid line distributor 30 intact, and with leaving both the relatively small liquid refrigerant transport line 6 exiting the interior air handler 5 and the heating mode expansion device 7 intact, all in conjunction with placing an appropriately sized restriction within the consolidated vapor refrigerant transport line 14, between the exterior heat exchanger's 8 exiting vapor line distributor 20 and the accumulator 12, provides an optimum hot gas refrigerant flow rate through both the interior heat exchanger 5 and the exterior heat exchanger 8 during the relatively short and relatively frequent primary and entire defrost cycles, as disclosed herein. For clarification, both a primary and an entire defrost cycle of operation about once every seven minutes, for a duration of no more than about 49 seconds, is relatively short and frequent when compared to customary and historical defrost cycles of operation about once every 30-90 minutes for a duration of about 4-12 minutes. Also, both a primary and an entire defrost cycle of operation about once every 7 minutes, for a duration of no more than about 40-45 seconds, is relatively short and frequent when compared to newer designs with defrost cycles comprised of 100 second defrost periods about once every 30-90 minutes, and even when compared with defrost cycles operating about once every 30-90 minutes, where the design calls for consecutively switching from heating to defrost modes once every 20-30 seconds on multiple occasions until the significant amounts of frost that has accumulated in the interim 30-90 minute period has melted.

This combination permits enough hot refrigerant gas to flow through the interior heat exchanger/air handler 5 to typically still provide over about half the heat (normally supplied to the interior air 9 during normal heat pump system operation) to the interior air during the defrost cycle, while permitting a sufficient amount of hot refrigerant gas to enter and flow through the exterior heat exchanger 8 to quickly melt the frost/ice without prematurely condensing the supplemental hot refrigerant gas within the exterior heat exchanger finned tubing 11. Thus, valuable heat does not have to be robbed from either the interior heat exchanger 5 (unnecessarily decreasing the otherwise available interior air heat supply), or from the exterior heat exchanger 8 (unnecessarily decreasing the available hot refrigerant gas to more quickly melt frost/ice), during the defrost cycle to provide supplemental heat to the accumulator 12.

While all of the above disclosures provide a very effective and efficient primary defrost design, testing has indicated the subject disclosures may be even further enhanced by controlling the operation of the exterior fan 13 situated within the exterior heat exchanger 8, all while leaving the interior fan 28, situated within the interior air handler 5, remaining in full and normal operation. As previously mentioned, as used herein, the term "primary defrost cycle" refers to the defrost cycle comprised of simultaneously opening the solenoid valve 18 in the supplemental hot gas refrigerant transport line 17 and engaging the restriction, such as demonstrated via an electronic valve 21, or the like, in the consolidated vapor refrigerant transport line 14; and the term "entire defrost cycle" refers to the primary defrost cycle period in conjunction with the interim period of time between when the exterior fan motor 19 is turned off (disengaged) and then is turned back on (engaged), typically consisting of about a twenty second period.

Specifically, testing has indicated that, during the entire defrost cycle of operation as disclosed herein, at least one of minimal to zero additional (typically zero additional) power requirements are imposed upon the heat pump system above those of normal system operation when, in addition to the above detailed descriptions, the exterior fan 13 is controlled by a controller 22, or the like. Here, a control wire 23 is shown as extending between the controller 22 and the exterior fan motor 19, so that the exterior fan 13 can be engaged (turned on) and disengaged (turned off). A control wire 23 is shown herein as an example only, since the exterior fan 13 may also be controlled by a wireless controller 22, or the like.

Specifically, the exterior fan 13 may be controlled to disengage (turn off) the motor 19 about five seconds before the primary defrost cycle disclosed herein is terminated, and to turn the exterior fan back on (engage the fan 13) about twenty seconds, plus or minus about five seconds, after the exterior fan's 13 motor 19 was turned off. The primary defrost system disclosed herein is deemed to have been started when both the open solenoid valve 18 and the restriction (as demonstrated by the electronic valve 21, for example) in the consolidated vapor refrigerant transport line 14 have both been engaged to function in a primary defrost cycle as disclosed herein, and the primary defrost system disclosed herein is deemed to have been stopped and terminated when after about twenty seconds later, plus or minus about five seconds: the solenoid valve 18 is closed (as opposed to the valve 18 being shown herein in an open position); and the primary defrost system disclosed herein is deemed to have been stopped and terminated when the restriction in the consolidated vapor refrigerant transport line 14 is removed and disengaged.

Therefore, when including a special exterior fan 13 operational control/timing element, as described above, in conjunction with the primary defrost cycle, to provide an entire defrost cycle that includes exterior fan control, multiple system operational and efficiency advantages are realized, in addition to load leveling and peak removal features important to utility companies supplying electrical power. Such an entire defrost cycle encompasses a maximum total of only about forty-five seconds only about once every approximate seven minute period. As previously explained, the maximum period for an entire defrost cycle, without impairing the interior heat supply by approximately more than about 50%, is about 49 seconds, comprised of an approximate twenty-nine second primary defrost cycle, in conjunction with the exterior fan motor 19 being disengaged for about five seconds before the end of the primary defrost cycle, and for about twenty seconds thereafter.

In many situations, testing has indicated that advantageous results are obtained by operating the primary defrost cycle for about 20 seconds, and by disengaging (turning off) the exterior fan 13 about 15 seconds after the primary defrost cycle started, and then by re-engaging (turning back on) the exterior fan 13 about 20 seconds after it was turned off during the primary defrost cycle. In such an instance, the entire defrost cycle encompasses a maximum total of only about 35 seconds only about once every approximate 7 minute period. After the entire defrost cycle of operation period, the exterior fan 13 would remain engaged and turned on for normal system operation, so long as the interior thermostat continues to call for heating mode operation.

However, as previously mentioned, testing has indicated that it may be advantageous to limit the time period for an entire defrost cycle to approximately 49 seconds or less. As explained, the 49 second entire defrost cycle may be comprised of a primary defrost cycle of approximately 29 seconds, in conjunction with the fan motor 19 being non-operative for a total period of about 25 seconds commencing about 5 seconds before the end of the primary defrost cycle and extending to about 20 seconds after the end of the primary defrost cycle. Otherwise, if a longer entire defrost cycle is utilized, the heat supply/return temperature delta to the interior air may be adversely lowered by more than about 50%. Interior air is not shown, but its direction through the interior air handler/heat exchanger 5 is indicated by wavy arrows 9 beneath the interior fan 28.

During the entire defrost cycle described herein, so long as the interior/indoor thermostat continues to call for heating mode operation, the interior fan 28 situated within the interior air handler 5 may remain in full and normal operation in order for the system as a whole to operate as intended at good operational efficiencies. The interior fan 28 may be turned off and disengaged only during a final primary defrost cycle when the interior thermostat no longer called for heat mode operation, and the interior fan motor 38 would only be normally turned back on (engaged) when the interior thermostat again called for heat. By turning off the interior fan motor 38 during a final primary defrost cycle, when the interior thermostat is no longer calling for heat, there is no normal heat transfer into the interior space (as there is no need for same), and some resulting additional heat will be transferred to the finned tubing 11 within the exterior heat exchanger 8, to more efficiently help to insure there is no frost/ice on the finned tubing 11 in the exterior heat exchanger 8 when the interior thermostat again calls for heat and normal heating mode system start-up. However, when the indoor thermostat is satisfied in the heating mode, the controller 22 device may turn off the exterior fan motor 19 within the exterior heat exchanger 8 about 5 seconds before the termination of the approximate 20 second, plus or minus about 5 seconds, primary defrost cycle, and the controller 22 does not turn the exterior fan motor 19 back on if the indoor thermostat has been satisfied until the indoor thermostat again calls for heat and normal system start-up, at which point the exterior fan 13 may be turned on in a normal system start-up mode As referenced, the exterior fan 13 may be turned on (engaged) and off (disengaged) by means of a controller 22, or the like, being programmed to send appropriate signals, though a control wire 23, or the like, to the exterior fan's 13 motor 19.

An outdoor air temperature sensor 33, or the like, could optionally be utilized to monitor outdoor air temperatures, to know when temperatures were about, or below, 40-45° F., to send a signal through a control wire 23, or the like, to the controller 22, which controller 22 would automatically engage the entire defrost cycle once at about every seven minute period or so, depending on outdoor temperature and humidity conditions.

Alternatively and/or in addition to an outdoor air temperature sensor 33, or the like, utilized to monitor outdoor air temperatures, a frost/ice sensor 34, or the like, could optionally be utilized to send a signal through a control wire 23, or the like, to the controller 22, which controller 22 would automatically engage the entire defrost cycle each time a threshold amount of frost/ice was detected on the exterior finned tubing 11 of the exterior heat exchanger 9.

Additionally, as previously mentioned, in an alternative final defrost cycle mode of operation, when the interior thermostat is satisfied and calls for the heat pump system to be turned off, a primary defrost cycle mode of operation may be conducted, but with the controller 22 disengaging the interior fan 28 during the entire final approximate 20 seconds, plus or minus about 5 seconds, of primary defrost cycle system operation, during which final approximate 20 second period, plus or minus about five seconds: the controller 22 would also call for the solenoid valve 18 in the new supplemental hot gas refrigerant transport line 17 to be in an open position; would additionally call for the approximate 94-96% restriction (such as via an electronic valve 21, or the like) within the consolidated vapor refrigerant transport line 14 (exiting the exterior heat exchanger 8) to be engaged; would call for the exterior fan motor 19 to be turned off about five seconds before the primary defrost cycle ended; and would call for operation of the compressor 1 to continue until termination of the primary defrost cycle.

At the termination of any such final defrost cycle mode of operation at the end of a period when the indoor thermostat had been satisfied, the controller 22: would call for the solenoid valve 18, or the like, within the new supplemental hot gas refrigerant transport line 17 to be closed; the approximate 94-96% restriction (such as via an electronic valve 21, or the like) within the consolidated vapor refrigerant transport line 14 (exiting the exterior heat exchanger 8) to be disengaged (opened); and all of the remaining operating mechanical parts (such as the compressor 1) to be disengaged and turned off. Thus, the system may be in a proper condition for normal system start-up when the interior thermostat again called for heating mode operation.

During all periods of both primary defrost cycles and entire defrost cycles, the compressor 1 would continue to be engaged (turned on). Also, at the termination of any final defrost cycle mode of operation at the end of a period when the indoor thermostat (not shown) has been satisfied, the controller 22 would call for the compressor to continue to run for the approximate typical 20 second, plus or minus about 5 second, period, after which the compressor 1 may be disengaged (turned off). Since the thermostat would typically call for the heat pump system to be turned off entirely when the indoor air temperature, or the like, was satisfied, a continued partial system operation for an approximate 20 second, plus or minus about 5 seconds, period may be controlled by the controller 22 via control wires 23 (shown as an example), or the like, operably connecting the controller 22: with the solenoid valve 18 in the supplemental hot gas refrigerant transport line 17; with the restriction (such as an electronic valve 21, or the like) in the connecting segment of refrigerant transport tubing 15; with the compressor 1; and optionally with the exterior fan motor 19 and/or the interior fan motor 38.

Control wires 23 (extending from the controller 22) are shown herein as an example, although the control wires 23 could be replaced with electronically transmitted signals, or the like. Here, the controller 22 is shown as powered by an electrical power supply cord 35.

As previously explained in more detail, for an optimum controller 22 frost/ice sensor 34 option, the entire defrost system cycle may be for a period of time that is only as long as necessary to melt the frost/ice on the finned tubing 11, which may be approximately 20-41 seconds. However, as also previously explained, the exterior fan motor 19 may be disengaged for approximately 20 seconds during an entire defrost cycle of any period of time within the approximately 49 second maximum time period.

As also previously explained, because the impact to the heat pump system and to the interior supply air temperature is relatively minimal, via operation of the entire defrost cycle as disclosed herein, that the entire defrost cycle may be engaged and implemented as often as necessary, whenever any predetermined amount of minimal frost/ice (not shown) is detected, by a frost/ice sensor 34, or the like, on the exterior heat exchanger's 8 heat exchange finned tubing 11, or the like.

The invention claimed is:

1. A heat pump having a heating mode, the heat pump comprising: a compressor having an inlet and an outlet; which outlet from the compressor directs heated refrigerant vapor into a vapor refrigerant transport line, having a first interior cross-sectional area, that transports heated refrigerant vapor exiting the compressor into an interior heat exchanger, which interior heat exchanger has a fan, and which interior heat exchanger includes distributed interior heat exchanger tubing; which distributed interior heat exchanger tubing is re-combined into at least one liquid refrigerant transport line, which liquid refrigerant transport line has a second interior cross-sectional area smaller than the first interior cross-sectional area, exiting the interior heat exchanger; which line with the second interior cross-sectional area, exits the interior heat exchanger and is next operably connected to a heating mode expansion device, which expansion device is positioned after the refrigerant exists the interior heat exchanger through the second interior cross-sectional area, but prior to the liquid refrigerant being next directed into a third refrigerant transport line, with an interior cross-sectional area equal to the first interior cross-sectional area; which liquid refrigerant transport line exiting the expansion device is comprised of the third refrigerant transport line between an exiting end of the expansion device and an entry point into a distributor, which distributes the refrigerant working fluid into heat exchange tubing within an interior of an exterior heat exchanger; which exterior heat exchanger includes distributed heat exchanger tubing within the exterior heat exchanger and an exterior heat exchanger fan; which distributed interior heat exchanger tubing is re-combined into at least one consolidated vapor refrigerant transport line upon exiting the exterior heat exchanger, which consolidated vapor refrigerant transport line has an interior cross-sectional area larger than the first interior cross-sectional area, which consolidated vapor refrigerant transport line ultimately transports vapor refrigerant back to an accumulator and then to the compressor; a connecting segment of vapor refrigerant transport tubing fluidly communicating between the refrigerant hot gas compressor discharge vapor line, with the first interior cross-sectional area exiting the compressor, but at a location before the hot gas compressor discharge vapor line enters the interior heat exchanger, and between the third refrigerant transport line with the interior cross-sectional area equal to the first interior cross-sectional area, situated at a location after the heating mode expansion device but before the third refrigerant transport line enters the exterior heat exchanger and the exterior heat exchanger's distributor; which connecting segment of vapor refrigerant transport line has a valve, that is operably connected to at least one controller, and which valve can be one of alternately opened and closed by the controller; which connecting segment of vapor refrigerant transport line has an interior cross-sectional area that is the same as the interior cross-sectional area of the first interior cross-sectional area of the hot gas refrigerant line transporting vapor refrigerant out of the compressor; which exterior heat exchanger has the fan controlled by the at least one controller, and which exterior heat exchanger includes the distributed exterior heat exchanger tubing; which distributed exterior heat exchanger tubing is re-combined into the at least one consolidated vapor refrigerant transport line, exiting the exterior heat exchanger; which consolidated vapor refrigerant transport line, transporting refrigerant fluid out of the exterior heat exchanger, is in fluid communication with, and ultimately transports refrigerant vapor to the accumulator and then into the compressor inlet; at least one of a restrictor valve with a by-pass line being disposed in the consolidated vapor refrigerant transport line, with the interior cross-sectional area larger than the first interior cross-sectional area, at a location between a consolidated vapor refrigerant transport line's exit point from the exterior heat exchanger and a consolidated vapor refrigerant transport line's entry point into the accumulator, which consolidated vapor refrigerant transport line next travels into the compressor, and which the restrictor valve is operably coupled/connected to the controller, whereby the restrictor valve operates so as to be fully open when the system is not in a defrost cycle, and operates in the defrost operation mode so as to close off and block about 94-96% of the interior cross-sectional area of the consolidated vapor refrigerant transport line, with the restrictor valve being positioned in the consolidated vapor refrigerant transport line between an exit point of the exterior heat exchanger and an entry point of the accumulator; the at least one controller operatively coupled to the exterior heat exchanger fan, the valve within the connecting segment of the vapor refrigerant transport line, and the restrictor valve within the consolidated vapor refrigerant transport line between the exit point of the exterior heat exchanger and the entry point to the accumulator, the at least one controller being programmed to operate the heat pump: in the heating mode in response to a heating demand, in which the compressor, the interior heat exchanger fan, and the exterior heat exchanger fan are engaged and the valve within the connecting segment of the vapor refrigerant transport line and the restrictor valve are in a fully open position; and in the defrost mode, in which the compressor is engaged, the interior heat exchanger fan is engaged, and the valve within the connecting segment of the vapor refrigerant transport line and restrictor valve are actuated to a respective refrigerant flow blocking position for a defrost period; wherein the defrost period lasts for approximately 20 to 45 seconds; wherein the exterior heat exchanger fan is disengaged about 15 seconds after the commencement of the defrost cycle, and is re-engaged at the earliest of: (a) about 20 seconds after the respective refrigerant flow blocking valves are returned to their fully open position during a continuing normal and non-defrost heating mode of system operation; and (b) when the entire system is re-engaged in response to a heating demand, after the entire system has been disengaged due to a lack of a continuing heating demand following termination of the defrost operation mode.

2. The heat pump of claim 1, where the distributed heat exchange tubing of the exterior heat exchanger is comprised of finned tubing.

3. The heat pump of claim 1, in which the defrost mode is engaged and implemented as often as necessary by the at least one controller whenever any pre-determined amount of minimal frost/ice is detected by a frost/ice sensor, or the like, on the exterior heat exchanger's heat exchange tubing.

4. The heat pump of claim 1, in which the defrost mode is engaged by the at least one controller when there is a sensed outdoor temperature of less than approximately 45° F.

5. The heat pump system of claim 4, where the defrost mode is repeated about once every seven minutes until the defrost mode of operation is no longer necessary.

6. The heat pump of claim 1, where an additional refrigerant charge amount is added to the system, which additional refrigerant charge amount is approximately equal to a total amount of extra liquid phase refrigerant necessary to fill an additional calculated interior content area, over that of a traditional amount of charge necessary to fill the traditional/conventionally smaller sized liquid line size that would conventionally be in the same location, within the larger-sized refrigerant transport tubing on the entering side of the exterior heat exchanger, which larger-sized than conventional tubing is situated between the heating mode expansion device and the distributed heat exchange tubing within the exterior heat exchanger.

* * * * *